US005087540A

United States Patent [19]

Murakami et al.

[11] Patent Number: 5,087,540

[45] Date of Patent: Feb. 11, 1992

[54] PHTHALOCYANINE PHOTOSENSITIVE MATERIALS FOR ELECTROPHOTOGRAPHY AND PROCESSES FOR MAKING THE SAME

[75] Inventors: Mutsuaki Murakami, Tokyo; Sohji Tsuchiya, Kanagawa; Atsushi Omote, Kawasaki, all of Japan

[73] Assignee: Matsushita Electric Industrial Co., Ltd., Japan

[21] Appl. No.: 551,538

[22] Filed: Jul. 12, 1990

[30] Foreign Application Priority Data

| | | | |
|---|---|---|---|
| Jul. 13, 1989 | [JP] | Japan | 1-181044 |
| Aug. 5, 1989 | [JP] | Japan | 1-203384 |
| Aug. 5, 1989 | [JP] | Japan | 1-203385 |
| Aug. 5, 1989 | [JP] | Japan | 1-203386 |
| Aug. 5, 1989 | [JP] | Japan | 1-203387 |
| Aug. 5, 1989 | [JP] | Japan | 1-203388 |
| Mar. 12, 1990 | [JP] | Japan | 2-60191 |
| Mar. 26, 1990 | [JP] | Japan | 2-76034 |
| Mar. 26, 1990 | [JP] | Japan | 2-76037 |
| Mar. 26, 1990 | [JP] | Japan | 2-76038 |

[51] Int. Cl.[5] ..... G03G 5/047; G03G 5/087

[52] U.S. Cl. ..... 430/58; 430/78; 430/135; 430/57

[58] Field of Search ..... 430/58, 78, 135

[56] References Cited

U.S. PATENT DOCUMENTS

| | | | |
|---|---|---|---|
| 3,357,989 | 12/1967 | Byrne et al. | 430/78 |
| 3,640,710 | 2/1972 | Mammino et al. | 430/96 |
| 3,672,979 | 6/1972 | Gerace et al. | 430/135 |
| 4,618,554 | 10/1986 | Ohashi et al. | 430/78 |
| 4,619,879 | 10/1986 | Kakuta | 430/58 |
| 4,868,079 | 9/1989 | Khe et al. | 430/72 |

FOREIGN PATENT DOCUMENTS 287700 10/1988 European Pat. Off. .

OTHER PUBLICATIONS

Patent Abstracts of Japan, vol. 13, No. 269 (P-888)(3617) Jun. 21, 1989 and JP-A-1 62648 (Alps Electric Co., Ltd.), Mar. 9, 1989.

Patent Abstracts of Japan, vol. 12, No. 436 (P-787)(3283) Nov. 17, 1988, and JP-A-63 165864 (Hitachi Chem. Co., Ltd.), Jul. 9, 1988.

"Bulk Optical Properties of Phthalocyanine Pigment Particles", by R. O. Loutfy; Can. J. Chem., vol. 59, 1981.

"Evidence for Exciton Fusion as the Origin of Charge Production in Molecularly Doped Polymers", by T. E. Orlowski et al.; 1983 The American Physical Society.

*Primary Examiner*—Roland Martin

*Attorney, Agent, or Firm*—Lowe, Price, Leblanc & Becker

[57] ABSTRACT

Photosensitive materials of the positive charging type which are useful in electrophotography are described. The material comprises a conductive support of any desired form and a photoconductive layer formed on the support. The photoconductive layer is made of X-type and/or $\tau$-type phthalocyanine compound dispersed in a binder resin. The compound is dispersed partly in a molecular state and partly in a particulate state in the resin. To make such a dispersion, the compound is agitated in a solvent along with the binder resin until charge transportability and charge generating ability are developed in the resultant photoconductive layer. Fundamentally, single-layer photosensitive materials with good photosensitive characteristics and a high heat resistance can be obtained.

24 Claims, 7 Drawing Sheets

PHTHALOCYANINE PHOTOSENSITIVE MATERIALS FOR ELECTROPHOTOGRAPHY AND PROCESSES FOR MAKING THE SAME

BACKGROUND OF THE INVENTION

1. Field of the Invention

This invention relates to the art of electrophotography and more particularly, to photosensitive materials for electrophotography which make use of organic photosensitive compounds and are particularly suitable for use in electrophotography for positive charge systems.

2. Description of the Prior Art

Extensive studies and developments have now been made on organic photosensitive substances or compounds. The organic photosensitive compounds have a number of advantages over inorganic photosensitive compounds, including the ease in preparation of a variety of compounds exhibiting high sensitivity at different wavelengths depending on the molecular design, little or no ecological problem, good productivity and economy, and inexpensiveness. Although the problems hitherto involved in organic photosensitive compounds include durability and sensitivity, these characteristic properties have been remarkably improved at present. Some organic photosensitive compounds have now been in use mainly as photosensitive materials for electrophotography.

Known organic photosensitive materials usually have a double-layer structure which includes a charge generating layer capable of absorbing light to generate carriers and a charge transfer layer wherein the generated carriers are transferred. Many attempts have been made to make photosensitive materials with high sensitivity. Known materials used to form the charge generating layer include perylene compounds, various phthalocyanine compounds, this pyrylium compounds, anthanthrone compounds, squalilium compounds, bisazo compounds, trisazo pigments, azulenium compounds and the like.

On the other hand, the materials used to form the charge transfer layer include various types of hydrazone compounds, oxazole compounds, triphenylmethane compounds, arylamine compounds and the like.

In recent years, there is a high demand of photosensitive materials for digital recording such as in laser printers wherein the organic photosensitive compounds indicated above are used in a near ultraviolet range corresponding to semiconductive laser beams with a wavelength range of from 780 to 830 nm. Accordingly, organic photosensitive compounds having high sensitivity in the above-indicated near ultraviolet range have been extensively studied and developed. In view of the sensitivity in the above UV range, organic photosensitive compounds are more advantageous than inorganic photosensitive compounds or materials.

The organic photosensitive compounds are usually employed in combination with binder resins and applied onto substrates, such as a drum, a belt and the like, by relatively simple coating techniques. Examples of the binder resins used for this purpose include polyester resins, polycarbonate resins, acrylic resins, acryl-styrene resins and the like. In general, with the double-layer structure, the charge generating layer is applied in a thickness of several micrometers in order to attain high sensitivity and the charge transfer layer is applied in a thickness of several tens of micrometers. From the standpoint of the physical strength and the printing resistance, the charge generating layer should generally be formed directly on the substrate and the charge transfer layer is formed as a surface layer. In this arrangement, charge transfer compounds which are now in use are only those which act by movement of positive holes. Thus, the known photosensitive materials of the double-layer structure are of the negative charge type.

The negative charge systems, however, have several disadvantages: (1) negative charges used for charging attack oxygen in air into ozone; (2) charging does not proceed satisfactorily; (3) the system is apt to be influenced by surface properties of a substrate such as a drum. Ozone presents the problem that not only ozone is harmful to human beings, but also it often reacts with organic photosensitive compounds to shorten the life of the photosensitive materials. The instability of the charging often invites a lowering of image quality. The influences of the surface properties requires a mirror finish on the substrate surface, thus needing an undercoating on the surface. This leads to an additional production cost. The known double-layer photosensitive materials have further disadvantages: (4) the fabrication process becomes complicated; and (5) the stability is not satisfactory because of the separation between the layers.

In order to solve the above problems, organic photosensitive materials of the positive charge type have been extensively studied. In order to attain the positive charge systems, attempts have been heretofore made including (1) reversed double-layer structures wherein the charge generating layer and the charge transfer layer are reversed to the case of the negative charge type; (2) single-layer structures wherein various types of charge generating compounds and charge transfer compounds are dispersed in binder resins; and (3) a single-layer structure wherein copper phthalocyanine is dispersed in polymers.

However, the reversed double-layer structure involves the problems similar to the negative charge system, i.e. complicated fabrication processes and the separation of the two layers. In addition, the charge generating layer, which has to be substantially thin, is placed on the surface of the photosensitive material with attendant problems such as reduction in the printing resistance and a poor life characteristic.

On the other hand, the photosensitive materials having the single-layer structure as in (2) and (3) above which are of the positive charging type are inferior to the double-layer structure photosensitive materials with respect to the sensitivity, charging characteristics, i.e. the materials are less likely to be charged, and a great residual potential. The reason why the sensitivity is poorer is that the generation and transfer of charges take place randomly in the single layer. Thus, the photosensitive materials having the single-layer structure has the problem to solve when used in practical applications.

As will be appreciated from the above, the known organic photosensitive materials have some problems to solve.

SUMMARY OF THE INVENTION

It is accordingly an object of the invention to provide organic photosensitive materials of the positive charge type having a single-layer structure which can solve the problems involved in the prior art organic photosensitive materials.

It is another object of the invention to provide organic photosensitive materials with a single-layer structure which have high sensitivity, a good residual potential and charge characteristics comparable to known organic photosensitive materials of the double-layer structure.

It is a further object of the invention to provide organic photosensitive materials with a single-layer structure which have high sensitivity and high durability.

It is a still further object of the invention to provide organic photosensitive materials with a single-layer structure which are applicable to various types of recording apparatus.

It is a yet further object of the invention to provide organic photosensitive materials having a double-layer structure which overcome the disadvantages of the prior art counterparts.

It is another object of the invention to provide a process for making an organic photosensitive material in an optimum manner.

The present invention is based on a finding that when X-type metal-free phthalocyanine and/or $\tau$-type metal-free phthalocyanine is mixed in a solvent therefor along with a binder resin to an extent and applied onto a conductive support, the resultant photoconductive layer exhibits both charge transportability and charge generating ability although the phthalocyanine is known as a charge generating agent.

Accordingly, the present invention broadly provides a photosensitive material which comprises which comprises a conductive support and an organic photoconductive layer formed on the conductive support and formed from a mixture of the least one compound selected from the group consisting of X-type metal-free phthalocyanine and $\tau$-type metal-free phthalocyanine and a binder resin which has been mixed in a solvent system for both the at least one compound and the binder resin until the photoconductive layer exhibits both charge transportability and charge generating ability.

In a physical aspect, the exhibition of the photoconductive layer is based on the at least one compound which is partly dispersed in a molecular state and partly dispersed in a particulate state in the resin binder. It will be noted that the term "dispersed in a molecular state" is intended to mean the state that the X-type and/or $\tau$-type metal-free phthalocyanine compound is at least partially dissolved in a solvent to a satisfactory extent along with a binder resin and is dispersed in the matrix of the resin binder in a molecular or dimer state after removal of the solvent and the term "dispersed in a particulate state" is intended to mean that the orginal crystal form of the compound remains after dispersion in the resin binder. As will be discussed hereinafter, there is the possibility that part of the phthalocyanine dispersed in a molecular state may be changed in crystal form from the originally used phthalocyanine. Whether the charge generating compound is dispersed in a molecular state and/or in a particulate state can be confirmed through X-ray diffraction and optical absorption analyses. Simply, the dispersion in the molecular state will be confirmed by an abrupt increase in viscosity when the at least one compound and a resin binder are mixed in a solvent therefor over a long term.

The organic photosensitive materials of the invention having a single-layer structure have the following advantages.

1. Because of the single-layer structure, the fabrication procedure is simple and a good printing resistance is obtained.

2. The sensitivity is significantly higher than that of known single-layer organic photosensitive materials with good charge characteristics and a good residual potential characteristic. When X or $\tau$-type metal-free phthalocyanine is used, good sensitivity to light with a wide wavelength range of from 550 to 800 nm is ensured.

3. The photosensitive materials exhibit good characteristics when used in positive charge systems.

4. Since any charge transfer compound which is less resistant to heat is not contained, the heat resistance is high.

As set out above, the photoconductive layer used in the materials of the invention does not contain any charge transfer compound. This reveals that the X or $\tau$-phthalocyanine compound in a certain condition has the charge transportability and that unlike known charge transfer compounds, positive charges are transferred. We believe that the transportability of positive charges depends mainly on the phthalocyanine compound dispersed in a molecular state and the ability of charge generation depends on the phthalocyanine compound dispersed in a particulate state. The two dispersion phases are created by mixing the phthalocyanine compound in a solvent along with a binder resin under agitation for a sufficient time of up to several days.

Although it has been stated above that the photosensitive material of the invention has a single-layer structure, the photoconductive layer may be of a double-layer structure wherein any charge transfer compound is not used. In this case, a layer of a charge generating compound dispersed in a resin binder in a particulate state is formed between the substrate and the layer having two dispersed states of the phthalocyanine compound. The charge generating compound may be X or $\tau$-phthalocyanine or other charge generating compounds.

DETAILED DESCRIPTION AND EMBODIMENTS OF THE INVENTION

Figure 1:
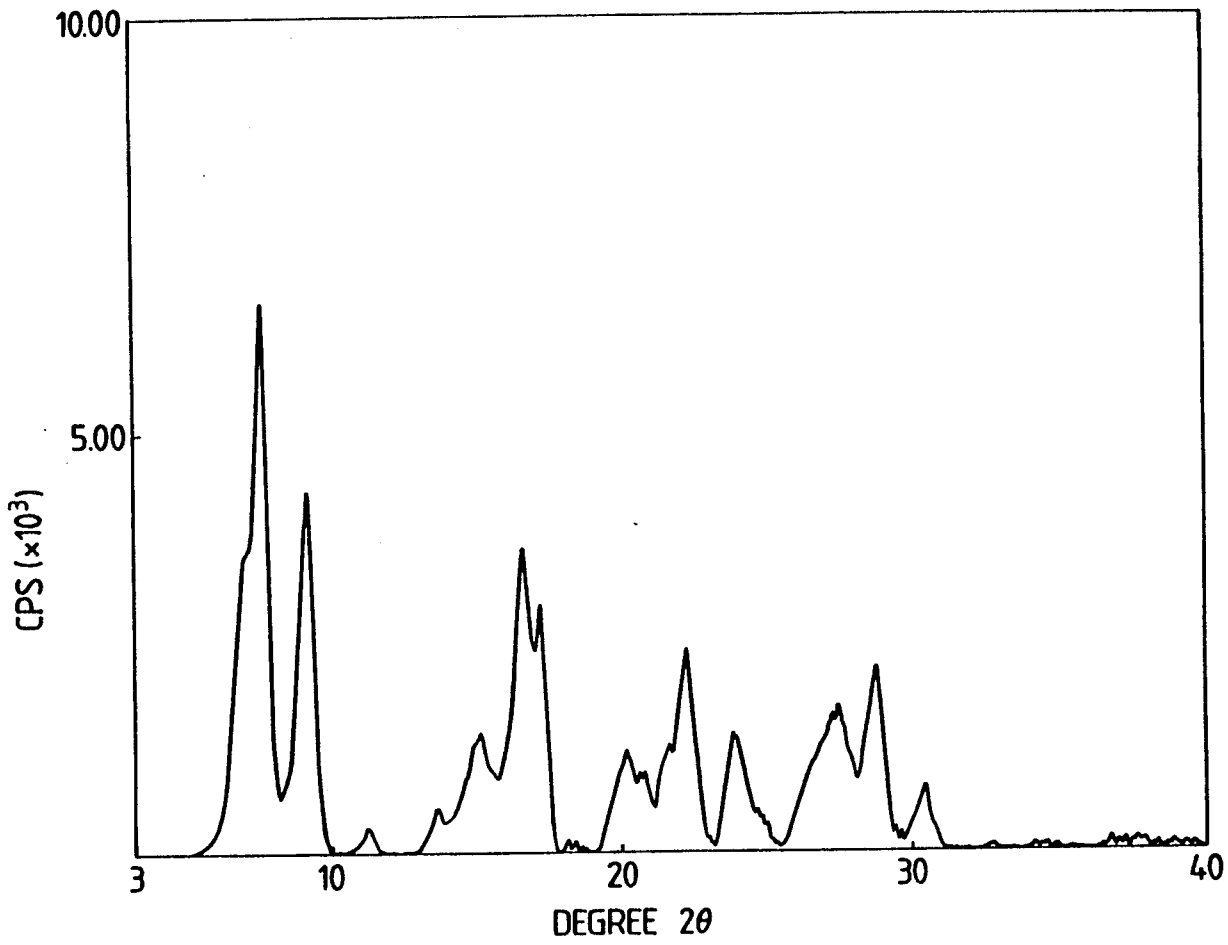
FIG. 1 is an X-ray diffraction pattern of X-type $H_2$-phthalocyanine.

As described before, the present invention broadly provides a positive charging phtosensitive material which has a single-layer structure. The single-layer structure includes a photoconductive layer which is formed on a conductive support.

The conductive support used in the present invention is not critical and may be made of any known materials ordinarily used for this purpose. Specific and preferable examples of the materials include metals such as aluminum, and those materials, such as glass, paper, plastics and the like, on which a conductive layer is formed such as by vacuum deposition of metals. The support may take any form such as of a drum, a belt, a sheet or the like.

In the practice of the invention, a photoconductive layer with a single-layer structure is formed on the support. The layer is made of at least one compound selected from X and $\tau$-type metal-free phthalocyanines and dispersed in a resin binder. The present invention is characterized in that the at least one compound and the binder resin should be mixed in a solvent system therefor until the resultant layer obtained from the mixture exhibits both charge transportability and charge generating ability wherein the at least one compound is dispersed partly in a molecular state and partly in a particulate or crystal state. Needless to say, the starting phthalocyanine compound is solid in nature at normal temperatures. It is considered that the molecularly dispersed compound takes part mainly in the charge transportability while the particulately dispersed compound takes part in the charge generating ability.

The X-type or $\tau$-type metal-free phthalocyanine is of the following formula

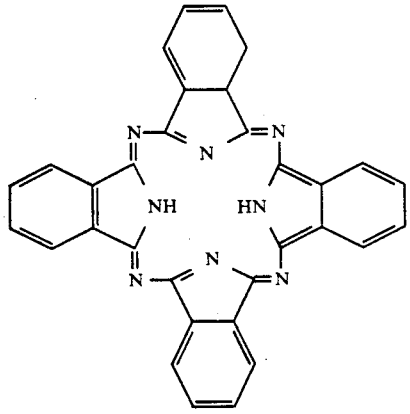

As stated above, part of the phthalocyanine compound should be dispersed in a resin binder in a molecular state. The phthalocyanine is not readily soluble in any solvent but are at least partially soluble in a number of solvents.

In order to realize the molecular state dispersion, the phthalocyanine compound is placed in a solvent capable of at least partially dissolving the compound therein and kneaded or mixed by means of an ordinary milling or kneading device over a long term, for example, of from several hours to several days. When the kneading operation is continued, the mixture is abruptly increased in viscosity. For instance, a mixture of 10 g of X-phthalocyanine and 50 g of polystyrene is agitated in 400 ml of tetrahydrofuran and the agitation is continued for one day or over. The solution is abruptly increased in viscosity from an initial value of about 40 cps., to about 1200 cps. This is considered to result from the dispersion of part of the phthalocyanine in a molecular state. Of course, the resin binder used should be selected as dissolved in a solvent for the phthalocyanine compound. Although depending on the type of resin binder, it is usual in the practice of the invention to knead or mill the mixture over several hours to several days until the viscosity increases abruptly, by which both charge transportability and charge generating ability are unexpectedly developed.

The molecular state dispersion may be confirmed through the X-ray diffraction and optical absorption analyses as will be particularly described hereinafter. By the increase in the viscosity, at least a part of the phthalocyanine compound will be dispersed in a molecular state with the balance remaining in a particulate state. Even if all the compound is completely dissolved in a solvent, part of the compound is inevitably crystallized during evaporation of the solvent to form the photoconductive layer. Accordingly, once the phthalocyanine has been compatibly dissolved in a solvent along with a binder resin, the resultant photoconductive layer would have two dispersion phases therein.

Figure 2:
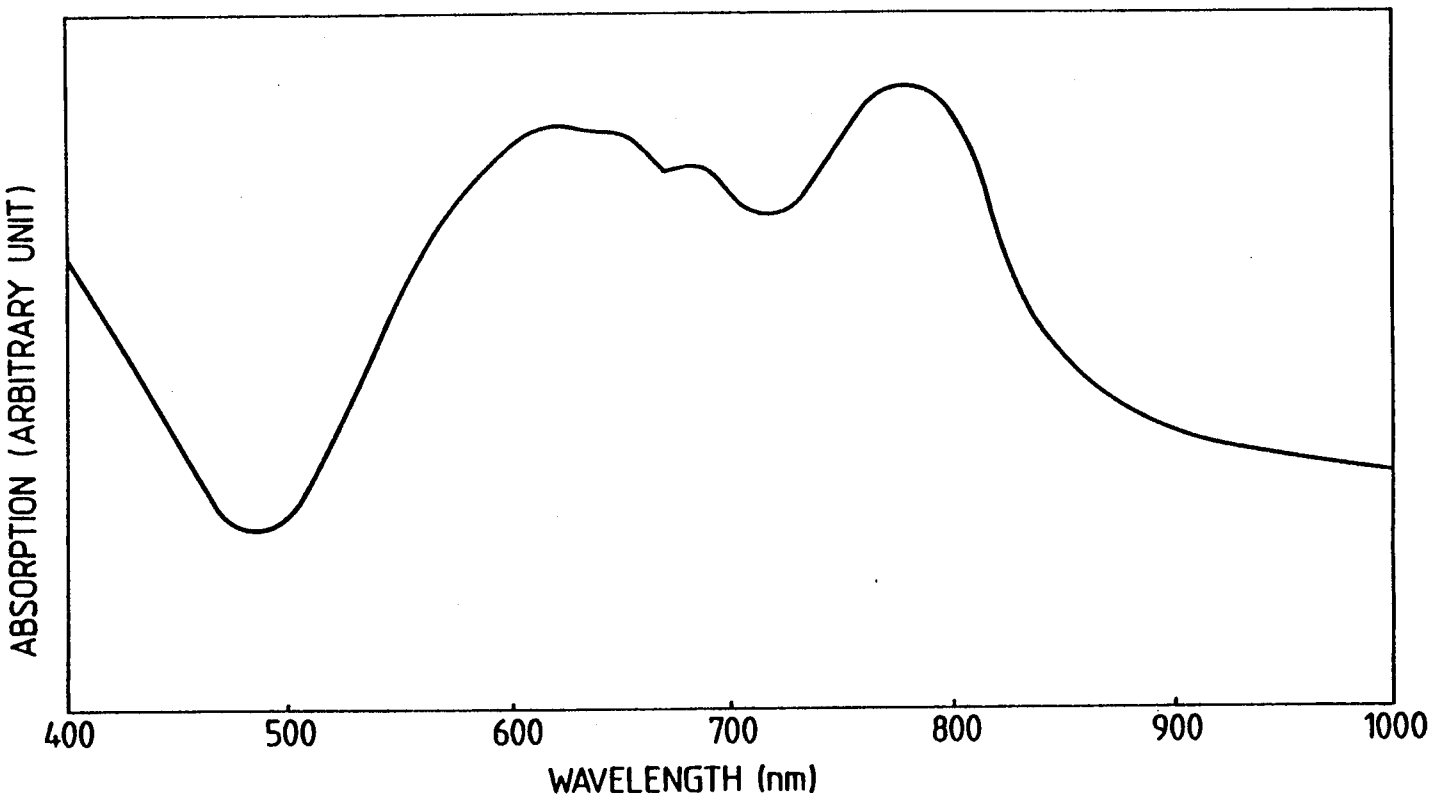
FIG. 2 is an absorption spectrum of X-type $H_2$-phthalocyanine.

X-type metal-free phthalocyanine was developed by Xerox Co., Ltd. and was reported as having excellent electrophotographic characteristics. In U.S. Pat. No. 3,357,989, the X-type phthalocyanine is described with respect to its preparation, the relationship between the crystal form and electrophotographic characteristics and the structural analyses. According to this U.S. patent, X-type $H_2$-Pc (phthalocyanine) is prepared by subjecting $\beta$ $_2$-Pc prepared by a usual manner to treated with sulfuric acid to obtain $\alpha$-type $H_2$-Pc and then to ball milling over a long time. The crystal structure of X-type $H_2$-Pc is apparently different from those of $\alpha$ or $\beta$-Pc. According to the X-ray diffraction pattern obtained with use of a CuK $\alpha$ line, the diffraction lines appear at $2\theta=7.4$, 9.0, 15.1, 16.5, 17.2, 20.1, 20.6, 20.7, 21.4, 22.2, 23.8, 27.2, 28.5 and 30.3° as is particularly shown in FIG. 1. The most intense diffraction peak appears in the vicinity of 7.5° (corresponding to a lattice spacing, d, =11.8 angstroms). When this intensity is taken as 1, the intensity of the diffraction line in the vicinity of 9.1° (corresponding to a lattice spacing, d, =9.8 angstroms) is 0.66. The ratio of the intensities is scarcely influenced by the crystal size. Moreover, the absorption spectra of X-type $H_2$-Pc are shown in FIG. 2, which apparently differ from those of $\alpha$-and $\beta$-type $H_2$-Pc. The difference in the absorption spectra owing to the difference in the crystal form results from the difference in the stacking state of the crystals of the $H_2$-Pc molecules. X-type $H_2$-Pc is reported as having a dimer structure.

Figure 3:
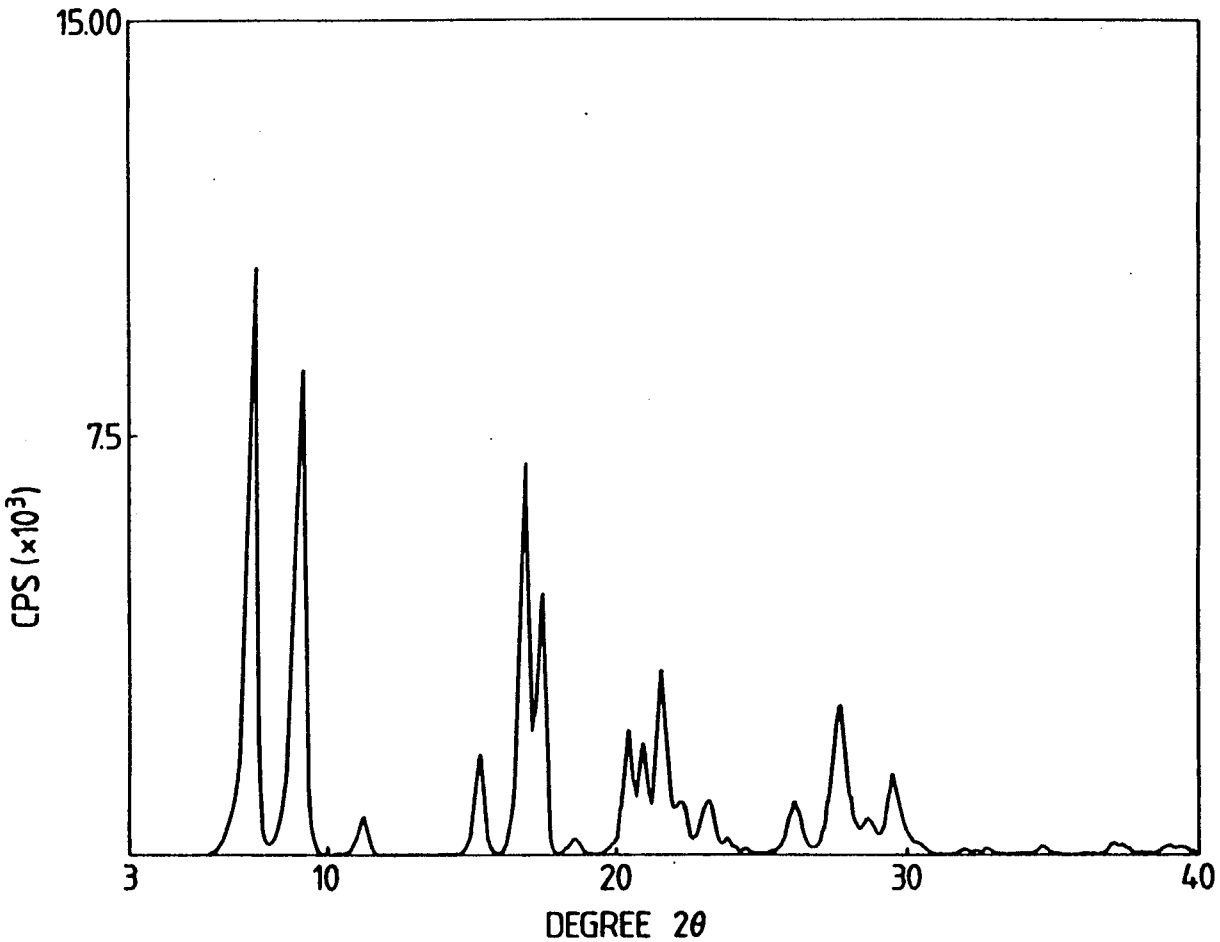
FIG. 3 is an X-ray diffraction pattern of $\tau$-type $H_2$-phthalocyanine.
Figure 4:
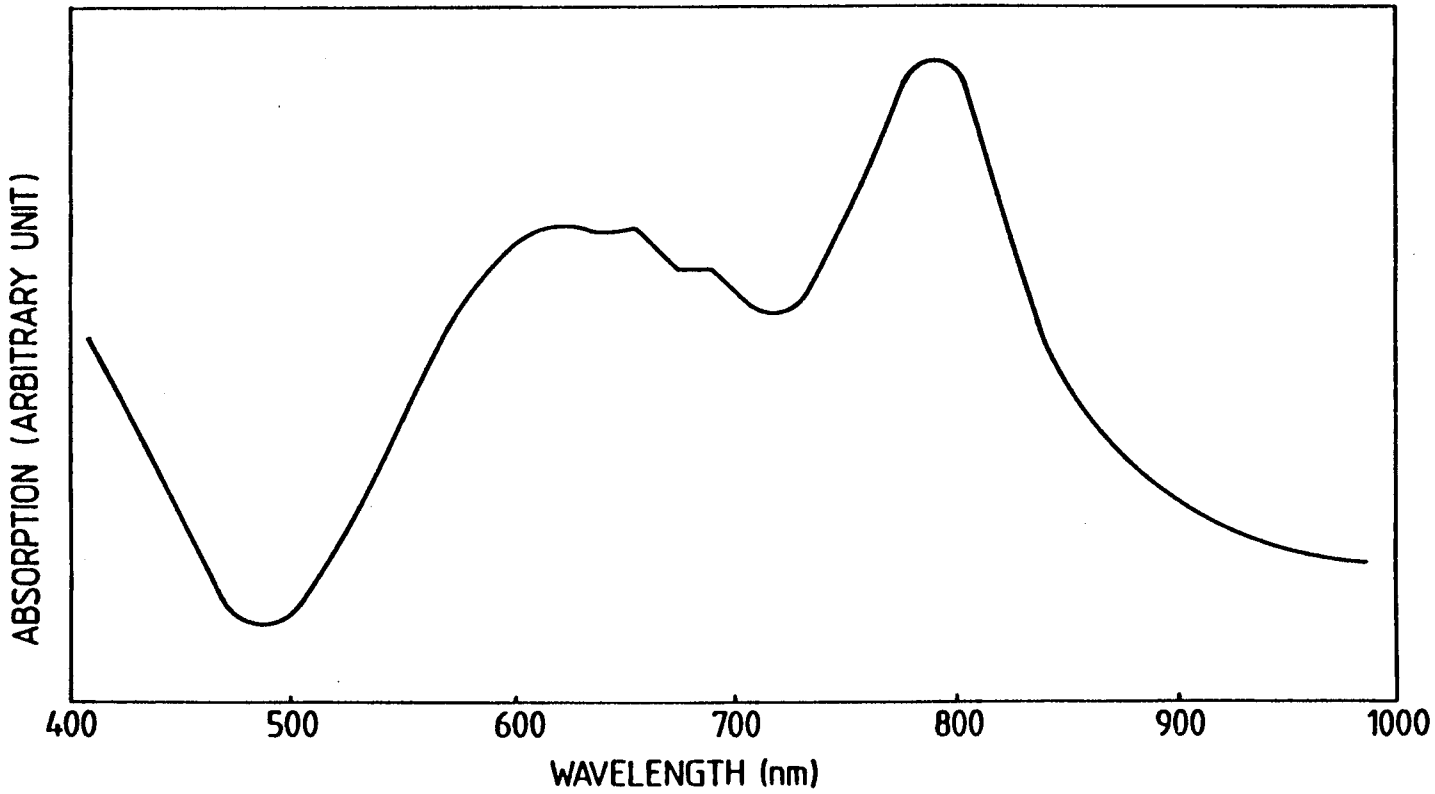
FIG. 4 is an absorption spectrum of $\tau$-type $H_2$-phthalocyanine.

Aside from the above crystal forms, $\tau$-type metal-free phthalocyanine is known. This phthalocyanine is obtained by subjecting to ball milling $\alpha,\beta$ and X-type crystals in an inert solvent along with a milling aid at a temperature of 5° to 10° C. for 20 hours. The X-ray diffraction pattern is shown in FIG. 3, from which it will be seen that the pattern is substantially similar to that of X type provided that the ratio of the diffraction peak intensity at about 7.5° and the diffraction peak intensity at about 9.1° is 1:0.8. FIG. 4 is an absorption spectrum chart of $\tau$-type crystals.

Figure 5:
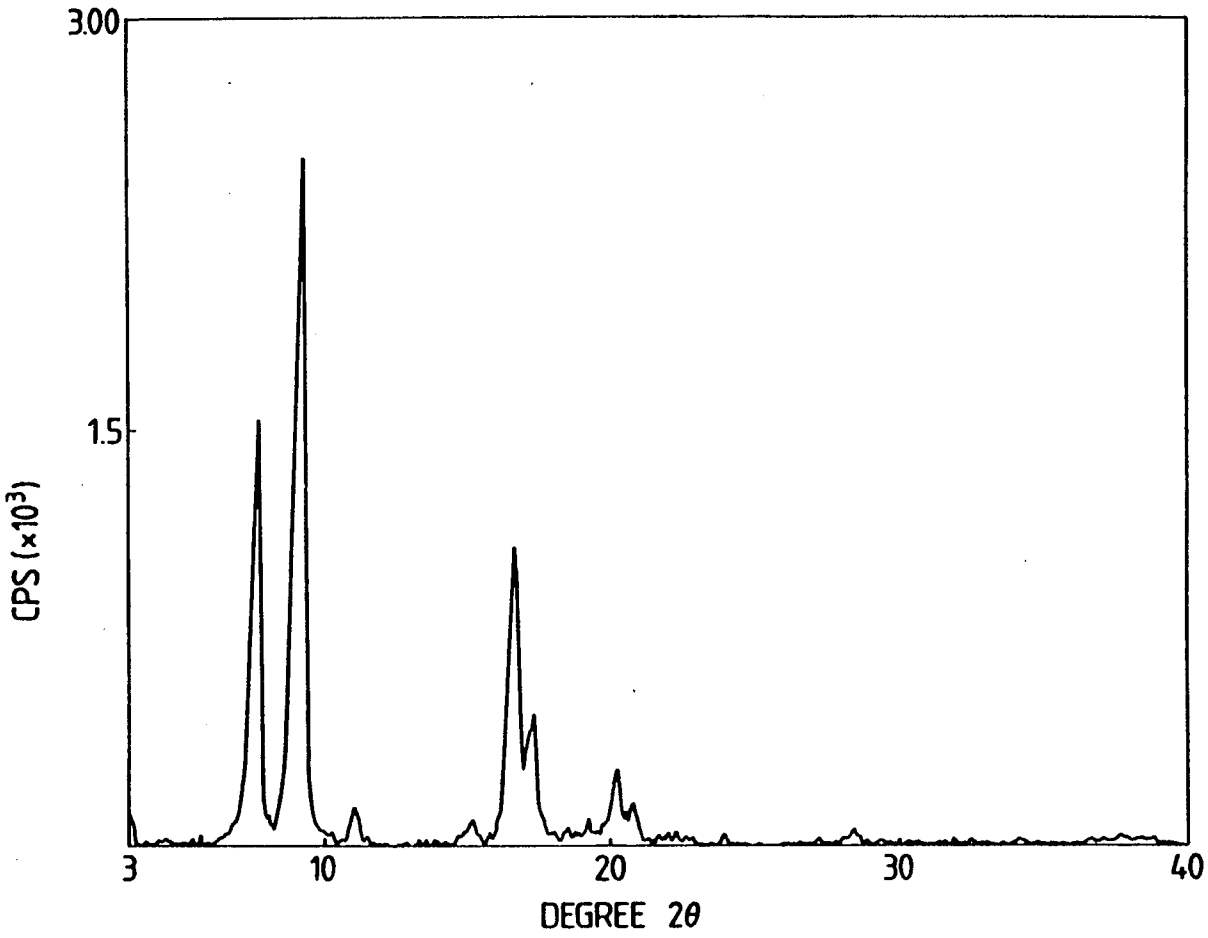
FIG. 5 is an X-ray diffraction pattern of the photosensitive material obtained according to the invention.

FIG. 5 shows an X-ray diffraction pattern of X-type $H_2$-phthalocyanine after sufficient kneading or mixing along with a binder resin according to the invention. This pattern apparently differs from those of FIGS. 1 and 3 and also differs from the X-ray diffraction patterns of $\alpha$ and $\beta$-$H_2$-phthalocyanines. The comparison between the patterns of FIGS. 1 and 5 reveals that with the X-ray diffraction pattern of FIG. 5, there is the tendency that the diffraction line over $2\theta=21.4°$ disappears with a tendency toward an increase at about 16.5° as compared with the pattern of FIG. 1. The most pronounced variation is that among two diffraction peaks at about 7.5° (d=11.8 angstroms) and about 9.1° (d=11.8 angstroms) which are inherent to $H_2$-Pc, only the peak at about 7.5° selectively disappears. This is considered as follows: the phthalocyanine crystals are converted into an amorphous state but with some possibility that an unknown crystal form may be formed from part of X-type $H_2$-Pc. It is stated herein that this state of X-type $H_2$-Pc is a dispersion of the X-type $H_2$-Pc in a molecular state.

The degree of mixing or kneading, and the mixing time and temperature depend on the types of solvent and resin binder. In order to obtain good characteristics as a photosensitive material, it is not favorable that the dispersion is insufficient or proceeds excessively. An optimum degree of the dispersion for the photosensitivity may be determined from a ratio of diffraction peak intensities at about 7.5° and about 9.1° ($I_{11.8}/I_{9.8}$). This ratio is preferably in the range of 1:1 to 0.1:1 for both X-type and $\tau$-type phthalocyanines.

Figure 6:
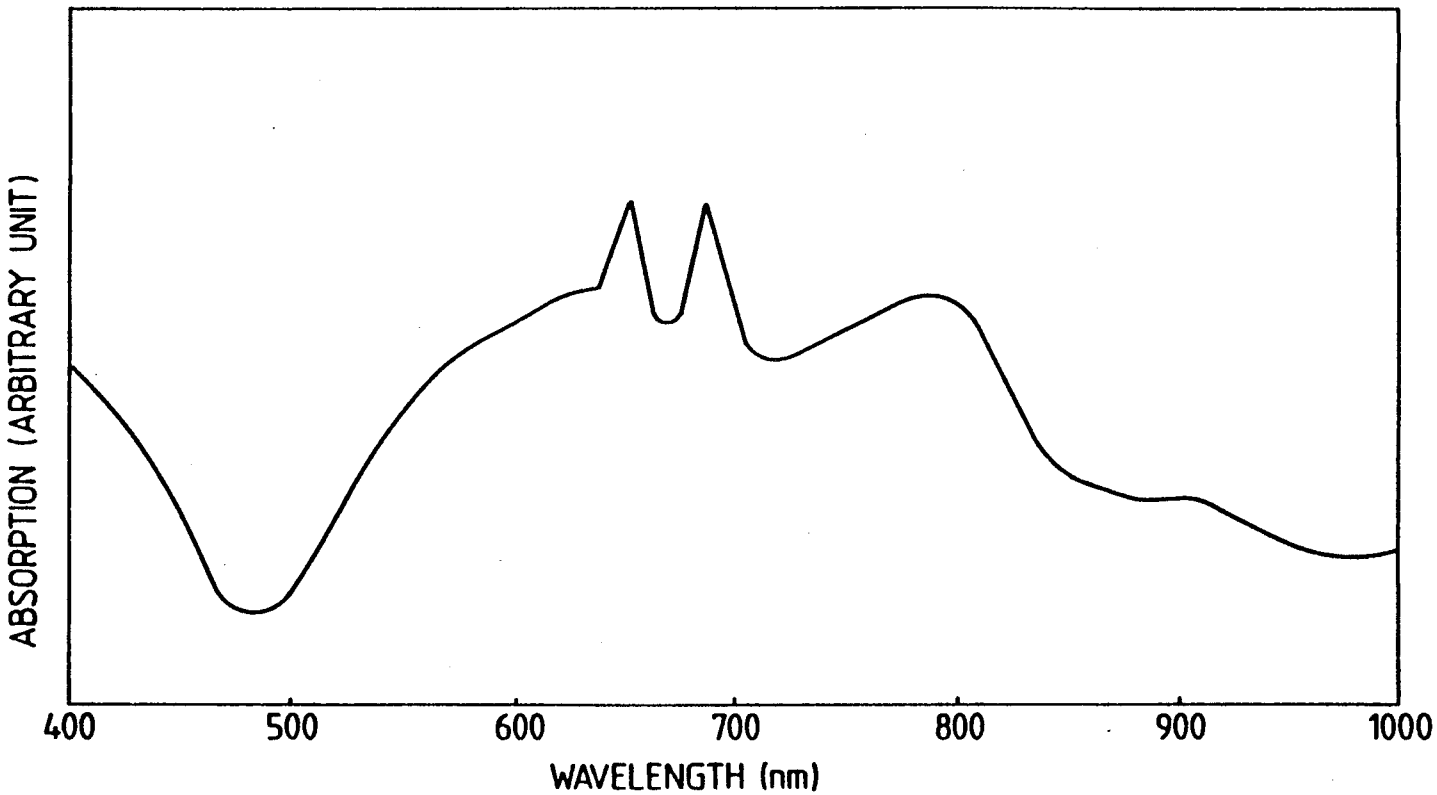
FIG. 6 is an absorption spectrum of the material obtained above.

The absorption spectrum chart of the photosensitive material using X-type phthalocyanine is shown in FIG. 6. The absorption spectra are completely different from those of FIGS. 2 and 4, giving evidence of X-type phthalocyanine which is not in the crystal form originally added to the mixing system.

In the practice of the invention, any charge transfer compound is not used. The photosensitive material of the invention is substantially different from known single-layer photosensitive materials using mixtures of charge generating compounds and charge transfer compounds. This gives evidence that the metal-free phthalocyanine compounds known as a charge generating agent, of the invention have the charge transportability under certain conditions. As set out before, it is belived that the phthalocyanine compound dispersed in a molecular state takes part in the charge transportability while the compound dispersed in a particulate state takes part in the charge generation. Thus, the manner of the dispersion of the compound in a resin binder is completely different from known positive charging single-layer organic photosensitive materials wherein charge transfer compounds and charge generating compounds are both dispersed in a particulate form. In the known single-layer photosensitive materials, hydrazone compounds, oxazole compounds, triphenylmethane compounds, arylamine compounds and the like are used as a charge transfer agent. If these compounds are added in an amount of not larger than 5 wt % based on the phthalocyanine compound in the photosensitive material of the invention, the photosensitive characteristics are scarcely improved. Over 5 wt %, the photosensitive characteristics and charge stability are considerably worsened. This demonstrates that charge transfer compounds adversely influence the photosensitive material of the present invention and thus, any charge transfer compound is not necessary in the present invention.

The phthalocyanine compounds used in the present invention should at least partially be dissolved in solvents although the solubility may vary depending on the type of solvent. Examples of the solvent capable of at least partially dissolving the X-type and $\tau$-type phthalocyanines used in the present invention include nitrobenzene, chlorobenzene, dichlorobenzene, trichloroethylene, chloronaphthalene, methylnaphthalene, benzene, toluene, xylene, tetrahydrofuran, cyclohexanone, 1,4-dioxane, N-methylpyrrolidone, carbon tetrachloride, bromobutane, ethylene glycol, sulforane, ethylene glycol monobutyl ether, acetoxyethoxyethane, pyridine and the like. Of these, tetrahydrofuran, chlorobenzene and methylnaphthalene are preferred. As a matter of course, other compounds capable of dissolving the phthalocyanines may also be used. The above solvents may be used singly or in combination.

The metal-free phthalocyanines are not dissolved in compounds such as acetone, cyclohexane, petroleum ether, nitromethane, methoxyethanol, acetonitrile, dimethylsulfoxide, ethyl acetate, isopropyl alcohol, diethyl ether, methyl ethyl ketone, ethanol, hexane, propylene carbonate, butylamine, water and the like. If these compounds are used as a solvent for resin binders, compounds capable of dissolving the phthalocyanines have to be used in combination.

The binder resins used in the present invention should preferably be ones which can be dissolved in the solvents for the phthalocyanine as mentioned above. The binder resins suitable for this purpose include polyesters, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of the monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof.

When two or more solvents are used in combination, it is possible to at least partially dissolved the phthalocyanine in one solvent and to dissolve the polymer in the other solvent. The resultant solutions are mixed together, followed by kneading to such an extent that the resultant layer exhibits both charge transportability and charge generating ability, i.e. the phthalocyanine is dispersed in a molecular or dimer state in the resin matrix and partly dispersed in a particulate or crystal state as described before.

The phthalocyanine compound and the binder resin should preferably be mixed at a ratio by weight of from 2:1 to 1:10, preferably 1:1 to 1:5. If the amount of the phthalocyanine compound is larger than the above range, the photosensitivity, i.e. the attenuation characteristic of potential by application of light, may become better, charge characteristics become worsened, making it difficult to charge the resultant photosensitive material at a potential of not lower than 300 volts. In contrast, if the amount of the resin binder is larger, the photosensitivity becomes poorer.

In the practice of the invention, any charge transfer compound is not necessary. This brings about a favorable side effect that the resultant photosensitive material is improved in heat resistance. More particularly, the heat resistance of prior photosensitive materials depends predominantly on the heat resistance of the charge transfer agent. Since the photosensitive material of the invention contains no charge transfer agent and the phthalocyanine compounds used in the present invention are very resistant to heat, the heat resistance of the photosensitive material of the invention depends substantially on the heat resistance of binder resins used.

In order to further improve not only the heat resistance, but also charge characteristics and the printing resistance after repetition cycles of electrophotographic operations, it is preferred to use crosslinked product of siloxanes, and cured products of mixtures of organic polymers and siloxanes. Examples of the siloxanes include methylphenylsiloxane, dimethylsiloxane and the like. Dimethylsiloxane is difficult in forming a film when used singly and is usually crosslinked with use of any known crosslinking agents ordinarily used for this purpose. Alternatively, it may be used in combination with organic polymers for film formation. On the other hand, methylphenylsiloxane has good film-forming properties when used singly. In order to further improve the film-forming properties, it may be used in combination with organic polymers. When used in combination with organic polymers, a methylphenylsiloxane varnish with a low degree of polymerization having terminal silanol groups or terminal methoxy groups is preferably used.

Examples of the organic polymers to be mixed with the siloxanes include alkyd resins, acrylic resins, carbonate resins, epoxy resins, melamine-formaldehyde resins, urea-formaldehyde resins, dioctyl phthalate resins, ethyl cellulose, phenolic resins, rosin-modified phenolic resins, styrenated alkyd resins, polyesters, epoxy-esterified resins, polyimides and mixtures thereof. Of these, alkyd resins, acrylic resins, carbonate resins, polyesters and polyimides are preferred. When the siloxanes are mixed with the organic polymer, the mixing ratio by weight of the siloxane and the organic polymer is in the range of from 1:4 to 4:1.

Moreover, dimethylsiloxane and methylphenylsiloxane may be used to modify various polymers as mentioned above, thereby giving kinds of copolymers such as by graft polymerization. These copolymers are also useful in the present invention. These copolymers are particularly described in examples appearing hereinafter.

When X-type phthalocyanine and methylphenylsiloxane are mixed, for instance, at a ratio by weight of 1:3 and used to form a single photoconductive layer, the resultant photosensitive material has a high sensitivity of 0.8 lux second (at a charging potential of 700 volts) in terms of a half-life exposure sensitivity as determined by a positive charge process. The sensitivity at 800 nm reaches 2.3 $cm^2/\mu$ J. This system is very stable and undergoes little characteristic change when subjected to a repetition test of 5000 cycles. In addition, when the photosensitive material is allowed to stand at 200° C. for 48 hours, little change is observed in the characteristics. Thus, the heat resistance is good.

Like siloxane-based resin binders, good results are obtained when photocurable resins are used. Specific examples of the photocurable resins include polymers of acrylates and/or methacrylates having a vinyl group or an epoxy group at side chains thereof and modified polystyrene resins having a chalcone structure at the side chains thereof. These polymers are cured by application of UV rays. As a matter of course, other light or heat curable resins may also be used in the present invention provided that they are dissolved in solvents for the phthalocyanine. In this case, the binder resin and the phthalocyanine is mixed at a ratio by weight of 1:1 to 1:10.

The photoconductive layer of the invention may further comprise other charge generating compounds. Examples of other charge generating compounds include perylene compounds, thiapyrylium compounds, anthanthrone compounds, squalilium compounds, diazo compounds, cyanine compounds, trisazo pigments, and azulenium dyes are used as an additional charge generating compound.

Specific examples of these compounds are shown below.

1. Metal phthalocyanines of the following formula

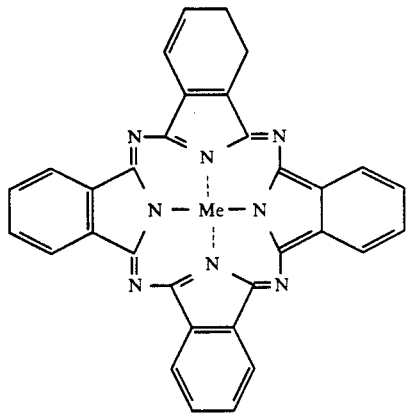

wherein Me represents a metal or a metal-containing group. Examples of the metalo-phthalocyanines useful in the present invention include copper phthalocyanine (which may be referred to simply as CuPc), lead phthalocyanine (PbPc), tin phthalocyanine (SnPc), silicon phthalocyanine (SiPc), vanadium phthalocyanine (VPc), chloroaluminium phthalocyanine (AlClPc), titanyl phthalocyanine (TiOPc), chloroindium phthalocyanine (InClPc), chlorogallium phthalocyanine (GaClPc) and the like. Of these, CuPc is preferred because of its better photosensitive characteristcs than those of $\gamma$-, $\epsilon$-, $\beta$- and $\alpha$-CuPc.

2. Perylene compound of the following formula

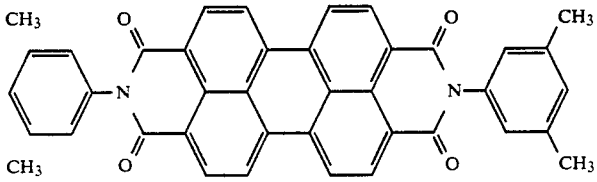

3. Perylene compound of the following formula

-continued
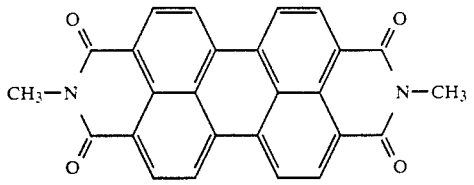
4. Compound of the following formula
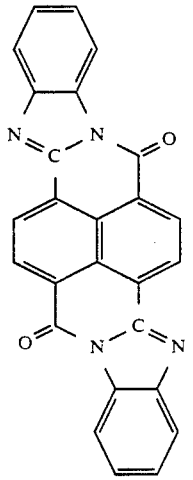
5. Anthanthrone compound of the following formula
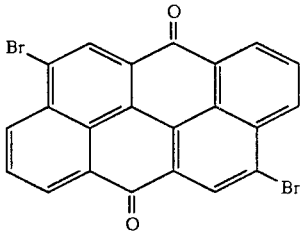
6. Thiapyrilium compound of the following formula
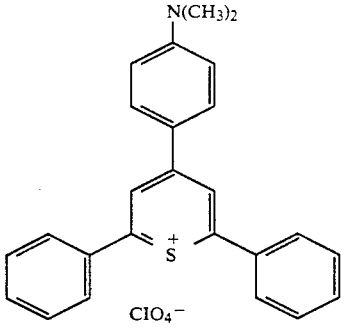
7. Compound of the following formula
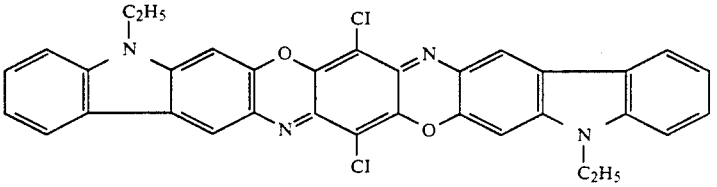
8. Squalilium compound of the following formula -continued
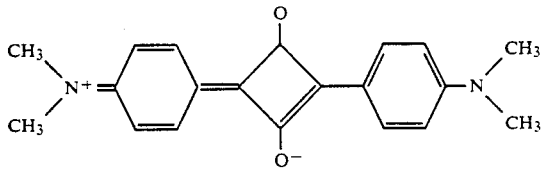
9. Cyanine compound of the following formula
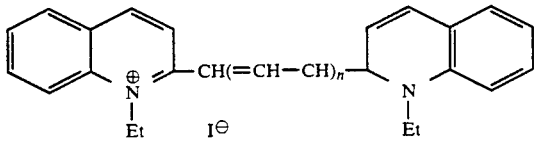
10. Squalilium compound of the following formula
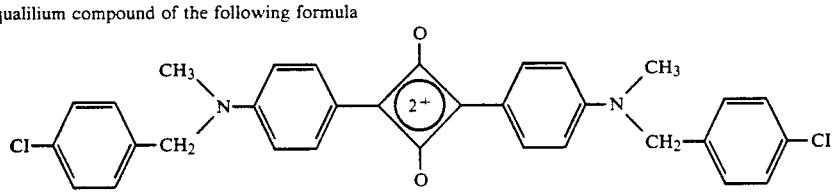
11. Azulenium dye of the following formula
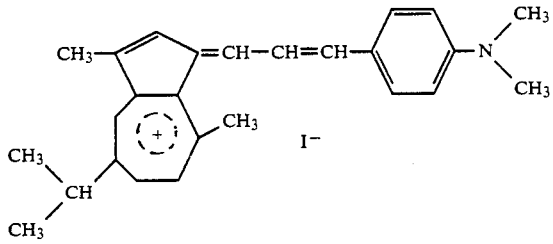
12. Trisazo compound of the following formula
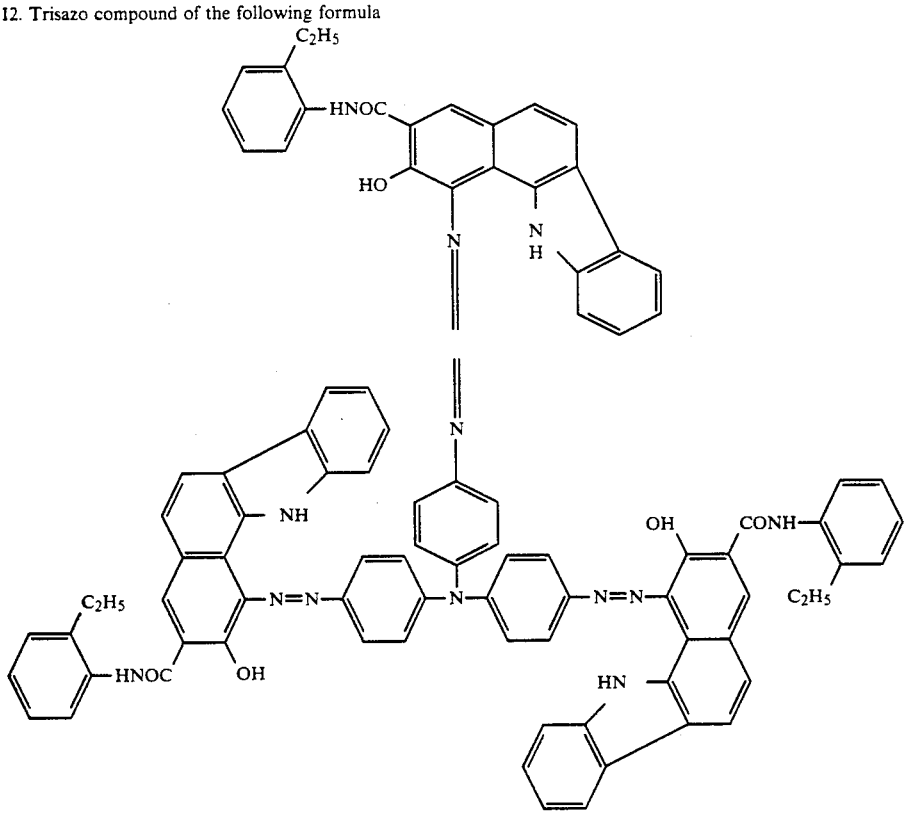
13. Diazo compound of the following formula -continued

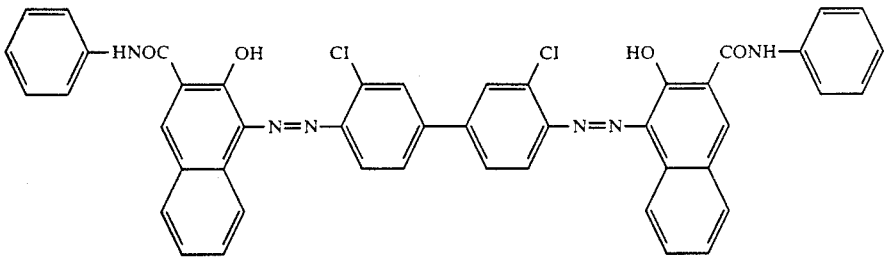

If other charge generating compounds are used in combination, the combination of the charge generating compounds and the resin binder are used at a mixing ratio by weight of 1:1 to 1:10. The X-type or τ-type metal-free phthalocyanine should preferably be contained in an amount of not less than 10 wt % of other charge generating compound or compounds used.

Alternatively, a layer of a charge generating compound may be formed directly formed on a substrate, on which the layer of the phthalocyanine compound dispersed in a resin binder is formed. In this case, the photosensitive material has a double-layer structure. The charge generating layer is formed by dispersing a charge generating compound in a resin binder as defined before by a simple mixing operation wherein the compound is dispersed only in a particulate state in the resin binder. The charge generating compound useful in this embodiment includes not only metalo-phthalocyanines, perylene compounds, thiapyrylium compounds, anthanthrone compounds, squalilium compounds, diazo compounds, cyanine compounds, trisazo pigments and azulenium dyes, but also X-type or τ-type metal-free phthalocyanine. As stated, the charge generating compounds used as the charge generating layer are simply dispersed in the form of crystals or particles, for example, in a liquid medium incapable of dissolving the charge generating compound although compounds capable of dissolving the charge generating compound may be likewise used as the liquid medium. The binder resins used are those set forth with respect to the single-layer structure.

The ratio by weight between the charge generating compound used as the charge generating layer and the resin binder is from 2:10 to 10:1. In this double-layer structure, the layer containing the phthalocyanine compound is formed in a manner as described with respect to the single-layer structure.

The photosensitive material according to the invention has substantially a single-layer structure in which X-type and/or τ-type phthalocyanine is dispersed in a resin binder partly in a molecular state and partly in a particulate state. When the photosensitive material is repeatedly used for printing, printed matters may contain black spots on a white background, which is often called a filming phenomenon. When have found that the filming phenomenon results from particles of the compound dispersed in a resin binder, which cause the surface of the photosensitive material to be irregular. The irregularities lead to the filming phenomenon.

In order to remove the above phenomenon, it is effective to smooth the surface of the photoconductive layer such as by rolling.

Preferably, the surface smoothing is carried out by dissolving the phthalocyanine in two solvents having different boiling points along with a binder resin. After proper kneading operations, the solution is applied onto a substrate and dried so that the solvent having a lower boiling point is evaporated but the other solvent having a high boiling point remains in the layer, during which the surface is smoothed by a suitable means. The rolling is the simplest smoothing operation. Examples of the combinations include tetrahydrofuran and methylnaphthalene, tetrahydrofuran and N-methylpyrrolidone, and the like. In practice, a lower boiling solvent is used in an amount larger than a higher boiling solvent. Generally, a ratio by weight between a lower boiling solvent and a higher boiling solvent is 5:1 to 50:1.

The photosensitive materials of the invention are of the positive charge type. When they are negatively charged, the sensitivity is significantly reduced with a low charge potential. The photoconductive layer of the materials according to the invention is generally in a thickness of from 4 to 50 micrometers when a single-layer structure is used. If the double-layer structure is used, the charge generating layer has generally a thickness of from 0.2 to 2 micrometers and the layer having two dispersed phases has a thickness of from 5 to 40 micrometers. Moreover, the photosensitive materials of the invention may further comprise a protective layer made of insulating resins and formed on the photoconductive layer. Alternatively, a blocking layer may be further provided between the substrate and the photoconductive layer.

For the fabrication of the photosensitive material of the invention, X-type and/or τ-type phthalocyanine compound and a resin binder are separately or simultaneously dissolved in a solvent or solvents and kneaded under agitation sufficient to cause the phthalocyanine compound to be dispersed partly in a molecular state and partly in a particulate state in the resin binder. For the dissolution, the solid content in the solution should preferably be in the range of from 2 to 40 wt % in order to facilitate the agitation. The agitation may be effected by any known means such as using a agitation blade or by milling. When the solution is abruptly increased in viscosity during the agitation, the agitation may be stopped or continued to a desired extent. The resultant solution is applied onto a conductive support by any known techniques such as dipping, coating and the like, in a dry thickness of from 4 to 50 μm for the single-layer structure. When a charge generating layer is formed between the conductive support and the photoconductive layer, a charge generating compound is dispersed in a liquid medium at a concentration of 2 to 20 wt % for a time of from 1 to 4 hours and applied onto the support prior to the formation of the photoconductive layer. The applied layer is dried preferably in vacuum at a temperature of from 50° to 180° C. for a sufficient time to form a photoconductive layer on the support as usual. During the drying, part of the phthalocyanine dissolved in a solvent is inevitably developed as particulate crystals. Part of the phthalocyanine is dispersed in the resin matrix in a molecular or dimer state as will be apparent from the X-ray diffraction pattern and the absorption spectrum as shown before.

Figure 7B:
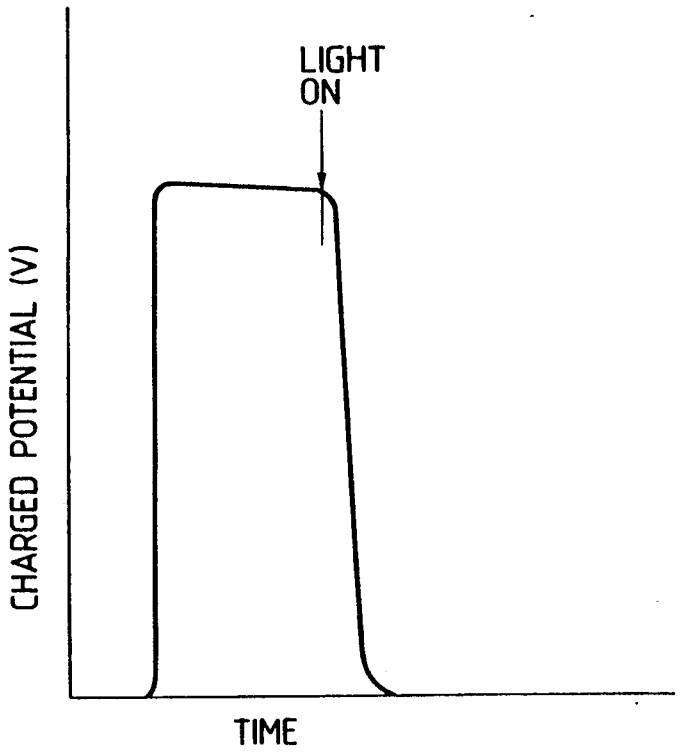
FIGS. 7*a* and 7*b* are, respectively, graphical representation of a photoresponse in relation to the variation in time for different photoconductive layers using a known dispersion of particulate crystals of X-type $H_2$-phthalocyanine and a dispersion of the invention wherein $H_2$-phthalocyanine is dispersed partly in a molecular state and partly in a particulate or crystalline state.
Figure 7A:
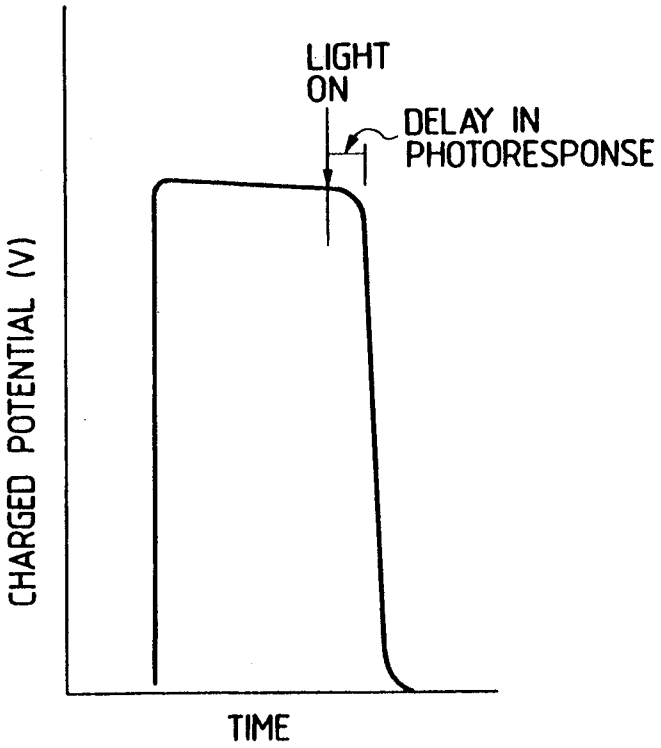

The photosensitive materials according to the invention are advantageous in that little delay in photoresponse is observed. This is particularly illustrated with reference to FIGS. 7*a* and 7*b* wherein FIG. 7*a* is illustrative of a photoresponse of a known positive charge single-layer photosensitive material wherein X-type metal-free phthalocyanine is merely dispersed in a resin binder in a particulate state and FIG. 7*b* is a illustrative of a photoresponse of a single-layer photosensitive material according to the invention. The comparison between FIGS. 7*a* and 7*b* reveals that the response to light irradiation is apparently delayed in FIG. 7*a* whereas little delay is observed in FIG. 7*b*. This is why the photosensitive material of the invention has high sensitivity. This seems to indicate the possibility that the photosensitive material of the invention has a photoconduction mechanism completely different from the known material.

The photosensitive materials of the invention exhibit good sensitivity to light with a wide wavelength range of from 550 to 800 nm.

The photosensitive materials of the invention are applicable to various types of printing systems including duplicating machines, printers, facsimiles and the like.

The present invention is described in more detail by way of examples. Comparative examples are also described.

EXAMPLE 1

X-type metal free-phthalocyanine (Fastogen Blue 8120B, made by Dainippon Inks Co., Ltd.) and polyvinyl butyral (Eslex BM-2, available from Sekisui Chem. Ind. Co., Ltd.) were weighed at different ratios indicated in Table 1 and dissolved in tetrahydrofuran, followed by kneading under agitation for two days to obtain a solution. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{178}$) and also a photosensitivity after repetition of 1000 exposure cycles. In addition, a wavelength characteristic in a range of 400 to 1000 nm was also measured. The results are shown in Table 1.

TABLE 1

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 200 | 0.6 | 0.8 | 2.9 |
| 1 | 1 | 300 | 0.6 | 0.7 | 2.8 |
| 1 | 1.5 | 350 | 0.7 | 0.7 | 2.6 |
| 1 | 2 | 410 | 0.8 | 0.8 | 2.5 |
| 1 | 3 | 530 | 1.0 | 0.9 | 2.4 |
| 1 | 4 | 600 | 1.0 | 1.0 | 2.2 |
| 1 | 5 | 700 | 1.5 | 1.4 | 1.8 |
| 1 | 8 | 910 | 1.8 | 2.0 | 1.8 |
| 1 | 10 | 1200 | 2.5 | 2.5 | 1.2 |

TABLE 1-continued

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 20 | 2000 | 3.8 | 5.2 | 0.6 |
| 1 | 50 | >2000 | >10 | >10 | >0.1 |

X-Pc: X-type phthalocyanine
PVB: polyvinyl butyral

As will be apparent from the above results, the ratio by weight of the X-Pc and PVB is appropriately in the range of 1:1 to 1:10, within which the charge characteristic and the photosensitive characteristics are both good.

When the photosensitive material using X-Pc and PVB at a mixing ratio of 1.3 was negatively charged, the photosensitivity was 1.5 lux.sec with a charged potential of 110 volts and was thus significantly inferior to the case where it was positively charged.

Moreover, when the above photosensitive material was allowed to stand at 150° for 48 hours and subjected to the measurement in the same manner as set forth above, little change in the characteristics was found.

COMPARATIVE EXAMPLE 1

For comparison, the general procedure of Example 1 as repeated except that a mixed solvent of acetone and dimethylformamide was used and certain mixing ratios of X-Pc and PVB were used as indicated in Table 2 below. It will be noted that acetone and dimethylformamide are both able to dissolve PVB but connot dissolve X-Pc. Accordingly, all X-Pc used is mixed in the resin binder in a particulate form and it is considered that any X-Pc dispersed in a molecular state is not present.

The results are shown in Table 2 below.

TABLE 2

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 80 | 5.6 | 6.8 | 0.1 |
| 1 | 1 | 130 | 5.2 | 7.7 | 0.08 |
| 1 | 2 | 250 | 8.7 | 9.2 | 0.06 |
| 1 | 5 | 500 | 10.6 | 12.8 | 0.04 |
| 1 | 10 | 630 | 21.5 | 20.9 | 0.02 |
| 1 | 20 | >2000 | >25.0 | >30.0 | <0.01 |

As will be apparent from the above results, the photosensitivity, $E_{\frac{1}{2}}$, is considerably poorer than those in Table 1. This will give evidence that it is necessary in the present invention that part of X-Pc be dispersed in the resin binder in a molecular state.

EXAMPLE 2

τ-Type metal free-phthalocyanine (hereinafter referred to simply as τ-Pc, Liophoton THP, available from Toyo Inks Co., Ltd.) and polyvinyl butyral (Eslex BM-2) were weighed at different ratios indicated in Table 3 and dissolved in tetrahydrofuran, followed by kneading under agitation for three days to obtain a solution. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 3.

TABLE 3

| τ-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 180 | 0.7 | 0.8 | 2.9 |
| 1 | 1 | 300 | 0.8 | 0.7 | 2.5 |
| 1 | 1.5 | 320 | 1.0 | 0.9 | 2.5 |
| 1 | 2 | 460 | 1.1 | 1.0 | 2.3 |
| 1 | 3 | 570 | 1.2 | 1.2 | 2.2 |
| 1 | 4 | 620 | 1.2 | 1.3 | 2.0 |
| 1 | 5 | 820 | 1.6 | 1.9 | 1.8 |
| 1 | 8 | 920 | 1.8 | 1.9 | 1.5 |
| 1 | 10 | 1400 | 2.6 | 2.7 | 1.1 |
| 1 | 20 | 2000 | 4.7 | 5.6 | 0.4 |
| 1 | 50 | >2000 | >10 | >10 | >0.1 |

From the above results, it will be seen that τ-Pc is excellent in the photosensitive characteristics similar to X-Pc.

EXAMPLE 3

X-type metal-free phthalocyanine (Fastogen Blue 8120B) were mixed with various types of binder resins at a mixing ratio by weight of 1:4 and each mixture was dissolved in tetrahydrofuran at a solid content of 20 wt %, followed by kneading under agitation. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 4.

TABLE 4

| polymer | Charged Potential (V) | Photosensitivity: Initial Half-life Exposure (lux · sec) | Photosensitivity: Half-life Exposure After 1000 Cycles (lux · sec) | Wave-length Characteristic ($cm^2/\mu J$) |
|---|---|---|---|---|
| polyester | 780 | 1.1 | 1.2 | 1.9 |
| vinyl chloride/ vinyl acetate copolymer | 600 | 1.6 | 1.5 | 1.8 |
| vinyl chloride/ vinyl acetate/ vinyl alcohol terpolymer | 630 | 1.4 | 1.5 | 1.8 |
| vinyl chloride/ vinyl acetate/ maleic acid terpolymer polycarbonate | 770 | 1.2 | 1.4 | 2.0 |
| | 620 | 1.4 | 1.4 | 2.0 |

The results reveal that good characteristics are obtained irrespective of the type of polymer provided that the polymers are dissolved in the solvent.

EXAMPLE 4

The photosensitive material obtained in Example 1 was subjected to a continuous printing test. The test was effected using A-4 size test paper sheets. As a result, it was found that the material was stable for the continuous running test of 30,000 sheets.

EXAMPLE 5

X-type metal-free phthalocyanine (Fastogen Blue 8120B, made by Dainippon Inks Co., Ltd.) and a methylphenylsiloxane solution (Silicone Varnish STR 117, available from Toshiba Silicone Co., Ltd.) in a mixed solvent of tetrahydrofuran, xylene and n-butanol at mixing ratios of 2:1:1 were mixed and kneaded under agitation for a time of two days. The phthalocyanine and the methylphenylsiloxane were mixed at different ratios indicated in Table 5 as solid matters. Each of the resultant solutions was applied onto an aluminium drum by dipping and treated in vacuum at 160° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 5000 exposure cycles. In addition, a wavelength characteristic in a range of 400 to 1000 nm was also measured. The results are shown in Table 5.

TABLE 5

| X-Pc | STR 117 | Charged Potential (V) | Photosensitivity: Initial Half-life Exposure (lux · sec) | Photosensitivity: Half-life Exposure After 5000 Cycles (lux · sec) | Wavelength Characteristic ($cm^2/\mu J$) |
|---|---|---|---|---|---|
| 1 | 0.8 | 250 | 0.6 | 0.8 | 2.9 |
| 1 | 1 | 360 | 0.6 | 0.7 | 2.8 |
| 1 | 1.5 | 450 | 0.7 | 0.8 | 2.5 |
| 1 | 2 | 550 | 0.8 | 0.8 | 2.4 |
| 1 | 3 | 700 | 0.8 | 0.9 | 2.3 |
| 1 | 4 | 800 | 1.1 | 1.1 | 2.2 |
| 1 | 5 | 700 | 1.5 | 1.6 | 1.7 |
| 1 | 8 | 1010 | 2.2 | 2.4 | 1.4 |
| 1 | 10 | 1500 | 3.2 | 3.5 | 1.1 |
| 1 | 20 | 2000 | 3.2 | 3.5 | 1.1 |
| 1 | 50 | >2000 | >10 | >10 | >0.1 |

Moreover, the photosensitive material using the X-Pc and the siloxane at a ratio of 1:3 was subjected to negative charge operations. The photosensitivity was found to be 22 lux.second and the charged potential was 110 volts. Thus, the material was not suitable for a negative charge system. Moreover, when the above material was allowed to stand at 200° C. for 48 hours and subjected to measurement in the same manner as set forth above, little change was observed in the characteristics. Thus, the heat resistance was good.

EXAMPLE 6

τ-Pc (Liophoton THP, available from Toyo Inks Co., Ltd.) and STR 117 were mixed in the same manner as in Example 11 at different ratios by weight indicated in Table 7, followed by kneading under agitation for three days to obtain a solution. Each solution was applied onto an aluminium drum by dipping and treated in vacuum at 160° C. for 1 hour to obtain a 10 to 20 μm thick photoconductive layer.

The thus obtained photosensitive materials were each subjected to measurement in the same manner as in Example 5. The results are shown in Table 6.

TABLE 6

| τ-Pc | STR 117 | Charged Potential (V) | Photosensitivity: Initial Half-life Exposure (lux · sec) | Photosensitivity: Half-life Exposure After 5000 Cycles (lux · sec) | Wavelength Characteristic ($cm^2/\mu J$) |
|---|---|---|---|---|---|
| 1 | 0.8 | 160 | 0.8 | 0.8 | 2.7 |
| 1 | 1 | 320 | 0.8 | 0.9 | 2.5 |
| 1 | 1.5 | 400 | 1.0 | 0.9 | 2.5 |
| 1 | 2 | 470 | 1.2 | 1.0 | 2.0 |
| 1 | 3 | 570 | 1.4 | 1.4 | 2.2 |
| 1 | 4 | 680 | 1.4 | 1.5 | 2.0 |
| 1 | 5 | 810 | 1.7 | 1.9 | 1.6 |
| 1 | 8 | 1050 | 2.8 | 2.9 | 1.1 |
| 1 | 10 | 1400 | 3.0 | 3.0 | 1.0 |
| 1 | 20 | 2000 | 4.7 | 5.6 | 0.4 |
| 1 | 50 | >2000 | >10 | >10 | >0.1 |

From the above results, it will be seen that τ-Pc is excellent in the photosensitive characteristics similar to X-Pc.

EXAMPLE 7

X-Pc (Fastogen Blue 8120B) and various types of methylphenylsiloxane and dimethylsiloxane-modified polymers used as a binder resin were employed to evaluate characteristic properties. X-Pc and each of the polymers were mixed at a mixing ratio by weight of 1:4 and dissolved in a mixed solvent of tetrahydrofuran and xylene at a solid content of 20 wt %, followed by kneading under agitation to obtain a solution. The thus obtained solution was applied onto an aluminium drum by dipping and treated in vacuum at 160° C. for 1 hour to form a photoconductive layer (10 to 20 μm).

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charging (half-life exposure, $E_{\frac{1}{2}}$) and also a photosensitivity after repetition of 5000 exposure cycles. The results are shown in Table 7.

TABLE 7

| Binder: Siloxane | Binder: Polymer | Photosensitive Characteristic (lux · sec): Initial Value $E_{\frac{1}{2}}$ | Photosensitive Characteristic (lux · sec): After 5000 Cycles $E_{\frac{1}{2}}$ |
|---|---|---|---|
| methyl-phenyl-siloxane | polyester | 1.5 | 1.6 |
| | polycarbonate | 1.8 | 1.7 |
| | alkyd resin | 2.2 | 2.5 |
| | acrylic resin | 2.7 | 3.0 |
| | epoxy resin | 2.2 | 2.1 |
| | polyimide | 3.8 | 3.5 |
| dimethyl-siloxane | polyester | 1.6 | 1.8 |
| | polycarbonate | 1.7 | 1.8 |
| | alkyd resin | 3.2 | 3.0 |
| | acrylic resin | 2.8 | 3.1 |
| | epoxy resin | 4.0 | 3.9 |
| | polyimide | 3.5 | 3.9 |

The above results reveal that the photosensitive materials using the siloxane-modified polymers exhibit good photosensitive characteristics and good stability after repetition of the exposure cycles.

It will be noted that the siloxanes may be mixed with organic polymers as used above with similar results except for a tendency that the stability becomes slightly poorer.

EXAMPLE 8

The photosensitive material obtained in Example 7 and having a mixing ratio of X-Pc and STR 117 of 1:4 was subjected to a heat resistance test and a continuous printing test. The heat resistance test using 200° C. and 48 hours revealed that no change was observed in the characteristics. In the continuous printing test, A 4-size paper sheets were continuously printed, from which it was found that the photosensitive material was stably worked.

EXAMPLE 9

X-Pc (Fastogen Blue 8120B) were mixed with a photocurable resin (FVR, copolymer of acrylates having a vinyl group and an epoxy group, respectively, available from Fuji Pharm. Co., Ltd.) at different mixing ratios by weight and each mixture was dissolved in cyclohexanone at a solid content of 20 wt %, followed by ball milling for two days. Each solution was applied onto an aluminium drum by dipping and treated in vacuum at 150° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K. K., in which white light from a halogen lamp was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 8.

TABLE 8

| X-Pc | FVR | Charged Potential (V) | Photosensitivity: Initial Half-life Exposure (lux · sec) | Photosensitivity: Half-life Exposure After 1000 Cycles (lux · sec) | Wavelength Characteristic 750 nm ($cm^2/\mu J$) |
|---|---|---|---|---|---|
| 1 | 0.8 | 200 | 0.8 | 0.8 | 2.2 |
| 1 | 1 | 330 | 0.9 | 0.9 | 2.1 |
| 1 | 1.5 | 400 | 1.0 | 1.0 | 2.0 |
| 1 | 2 | 510 | 1.1 | 1.0 | 1.5 |
| 1 | 3 | 530 | 1.5 | 1.3 | 1.0 |
| 1 | 4 | 600 | 1.8 | 1.5 | 1.0 |
| 1 | 5 | 700 | 2.0 | 1.8 | 0.8 |

TABLE 8-continued

| X-Pc | FVR | Charged Potential (V) | Photosensitivity: Initial Half-life Exposure (lux · sec) | Photosensitivity: Half-life Exposure After 1000 Cycles (lux · sec) | Wavelength Characteristic 750 nm ($cm^2/\mu J$) |
|---|---|---|---|---|---|
| 1 | 8 | 910 | 2.7 | 2.4 | 0.6 |
| 1 | 10 | 1200 | 3.5 | 3.2 | 0.4 |
| 1 | 20 | 2000 | 5.5 | 7.2 | 0.2 |
| 1 | 50 | >2000 | >10 | >10 | >0.1 |

As will be apparent from the above results, the ratio by weigh to X-Pc and FVR is preferably in the range of from 1:1 to 1:10.

EXAMPLE 10

τ-Pc (Liophoton THP) and a curable polymer (FVDR, a polystyrene resin having a chalcone structure at side chains, available from Fuji Pharm. Co., Ltd.) were mixed at a mixing ratio by weight of 1:2 and dissolved in tetrahydrofuran, followed by ball milling for two days to obtain a solution. The solution was applied onto an aluminium drum by dipping and thermally treated in air under different conditions to form a photoconductive layer with a thickness of 10 to 20 μm.

The thus obtained photosensitive materials were each subjected to measurement of photosensitivity by the use of Paper Analyzer Model EPA-8100, made by Kawaguchi Denki K.K., in which white light from a halogen lamp was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 9.

TABLE 9

| Heating Conditions | Charged Potential (V) | Initial Photosensitivity (lux · sec) | Residual Potential (V) |
|---|---|---|---|
| 60° C., 30 minutes | 670 | 4.0 | 5 |
| 80° C., 30 minutes | 650 | 3.5 | 3 |
| 120° C., 30 minutes | 640 | 2.8 | 3 |
| 150° C., 30 minutes | 620 | 1.8 | 2 |
| 200° C., 60 minutes | 610 | 1.2 | 2 |

From these results, it will be seen that τ-Px exhibits so good photosensitive characteristics as X-Pc and that the characteristics are improved when optimum heating conditions are used. In addition, a very low residual potential is obtained using this type of binder resin.

EXAMPLE 11

The general procedure of Example 10 was repeated except that a mercury lamp was used for curing. The results are shown in the following table.

TABLE 10

| Irradiation Time | Charged Potential (V) | Initial Photosensitivity (lux · sec) | Residual Potential (V) |
|---|---|---|---|
| 15 minutes | 670 | 5.5 | 20 |
| 30 minutes | 650 | 3.0 | 10 |
| 45 minutes | 630 | 2.0 | 5 |
| 60 minutes | 610 | 1.8 | 3 |

As will be apparent from the above, similar effects as in the heating are obtained. When the irradiation time was 1 hour or over, no change in the characteristics was found. Within a shorter time, the characteristics are more improved with an increasing irradiation time.

EXAMPLE 12

The photosensitive material obtained in Example 10 and thermally treated at 200° C. was allowed to stand under conditions of 80° C. and 90% R.H. for 1 month, followed by measurement of the characteristics in the same manner as in Example 15. As a result, the characteristics were not worsened.

EXAMPLE 13

The photosensitive material obtained in Example 9 and using X-Pc and FVR at a mixing ratio of 1:4 was provided for a continuous printing test using A4-size test paper sheets. The material was stable for the continuous test of 30,000 sheets.

EXAMPLE 14

Three ingredients including X-Pc (Fastogen Blue 8120B), a trisazo compound of the following formula prepared according to a process described in Ricoh Technical Report No. 8 Nov., 14 (1982), and polyvinyl butyral (Eslex BM-2) were dissolved in tetrahydrofuran at different mixing ratios by weight indicated in Table 12, followed by kneading under agitation for two days.

The solution was applied onto an aluminium drum by dipping and treated in vacuum at 120° C. for 1 hour to form a photoconductive layer with a thickness of 10 to 20 μm.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. The results are shown in Table 11.

TABLE 11

| X-Pc | Charge Generating Compound | PVB | Charged Potential (V) | Initial Photosensitivity (lux · sec) | Photosensitivity After 1000 Cycles (lux · sec) |
|---|---|---|---|---|---|
| 0.2 | 0.4 | 0.5 | 200 | 0.9 | 1.0 |
| 0.2 | 0.4 | 1 | 300 | 1.2 | 1.2 |
| 0.2 | 0.4 | 1.2 | 420 | 1.4 | 1.6 |
| 0.2 | 0.4 | 1.8 | 600 | 1.6 | 1.8 |
| 0.2 | 0.4 | 3.0 | 710 | 2.0 | 2.3 |
| 0.2 | 0.4 | 6.0 | 820 | 2.6 | 2.5 |
| 0.2 | 0.4 | 10.0 | 1500 | 4.6 | 4.9 |
| 0.01 | 0.59 | 1.8 | 750 | 5.0 | 5.7 |
| 0.02 | 0.58 | 1.8 | 700 | 4.6 | 5.8 |
| 0.05 | 0.55 | 1.8 | 660 | 3.3 | 3.7 |
| 0.1 | 0.5 | 1.8 | 670 | 1.9 | 1.8 |
| 0.2 | 0.4 | 1.8 | 600 | 1.6 | 1.8 |
| 0.3 | 0.3 | 1.8 | 580 | 1.2 | 1.0 |
| 0.4 | 0.2 | 1.8 | 400 | 1.2 | 0.9 |
| 0.5 | 0.1 | 1.8 | 370 | 1.2 | 1.0 |

As will be apparent from the above results, the ratio of the total of X-Pc and the charge generating compound and PVB is preferably in the range of from 1:1 to 1:10, within which good charge characteristic and sensitivity are obtained. Moreover, the ratio by weight of XPc and the additional charge generating compound is preferably in the range of from 1:10 to 5:1.

COMPARATIVE EXAMPLE 2

The general procedure of Example 14 was repeated except that a mixed solvent of acetone and dimethylformamide was used instead of tetrahydrofuran and certain mixing ratios indicated in Table 12 were used. As stated before, acetone and dimethylformamide both do not dissolve X-Pc but dissolve PVB. In this system, X-Pc was dispersed in the PVB in a particulate state. The results are shown in Table 12.

TABLE 12

| X-Pc | Charge Generating Compound | PVB | Charged Potential (V) | Initial Photosensitivity (lux · sec) | Photosensitivity After 1000 Cycles (lux · sec) |
|---|---|---|---|---|---|
| 0.2 | 0.4 | 1.0 | 700 | 6.6 | 6.8 |
| 0.2 | 0.4 | 1.8 | 800 | 8.6 | 9.7 |
| 0.2 | 0.4 | 3.0 | 1200 | 10.0 | 10.8 |
| 0.2 | 0.4 | 6.0 | 2000 | 18.6 | 17.5 |
| 0.1 | 0.5 | 1.8 | 200 | 9.6 | 10.9 |
| 0.3 | 0.3 | 1.8 | 300 | 5.6 | 7.7 |

As will be apparent from the above results, the photosensitivity, $E_{\frac{1}{2}}$, by positive charge is considerably poorer than those in Table 11. Thus, it is necessary that part of X-Pc be dispersed in the binder resin in a molecular state.

EXAMPLE 15

Three ingredients including τ-Pc (Liophoton), a trisazo compound as used in Example 14 and polyvinyl butyral (Eslex BM-2) were dissolved in tetrahydrofuran at different mixing ratios by weight indicated in Table 13, followed by kneading under agitation for three days. Each solution was applied onto an aluminium drum by dipping and treated in vacuum at 120° C. for 1 hour to form a photoconductive layer with a thickness of 10 to 20 μm.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. The results are shown in Table 13.

TABLE 13

| τ-Pc | Charge Generating Compound | PVB | Charged Potential (V) | Initial Photosensitivity (lux · sec) | Photosensitivity After 1000 Cycles (lux · sec) |
|---|---|---|---|---|---|
| 0.2 | 0.4 | 1 | 350 | 1.4 | 1.5 |
| 0.2 | 0.4 | 1.2 | 520 | 1.6 | 1.6 |
| 0.2 | 0.4 | 1.8 | 700 | 1.8 | 2.0 |
| 0.2 | 0.4 | 3.0 | 730 | 2.2 | 2.3 |
| 0.2 | 0.4 | 6.0 | 980 | 2.9 | 3.0 |

TABLE 13-continued

| τ-Pc | Charge Generating Compound | PVB | Charged Potential (V) | Initial Photosensitivity (lux · sec) | Photosensitivity After 1000 Cycles (lux · sec) |
|---|---|---|---|---|---|
| 0.02 | 0.58 | 1.8 | 620 | 4.2 | 5.0 |
| 0.05 | 0.55 | 1.8 | 720 | 2.0 | 2.2 |
| 0.1 | 0.5 | 1.8 | 720 | 2.0 | 2.2 |
| 0.2 | 0.4 | 1.8 | 650 | 2.0 | 1.8 |
| 0.3 | 0.3 | 1.8 | 500 | 1.8 | 1.7 |
| 0.4 | 0.2 | 1.8 | 410 | 1.5 | 1.7 |

As will be apparent from the above results, τ-Pc exhibits good photosensitive characteristics as X-Pc.

EXAMPLE 16

X-Pc (Fastogen Blue 8120B), the charge generating compound as used in Examples 14 and 15 and each of various binder resins were mixed at mixing ratios by weight of 0.2:0.4:1.8 and dissolved in tetrahydrofuran, followed by sufficiently kneading under agitation for three days. The respective solutions were applied onto an aluminium drum by dipping and treated in vacuum at 120° C. for 1 hour to form a photoconductive layer with a thickness of 10 to 20 μm.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. The results are shown in Table 14.

TABLE 14

| Polymer | Charged Potential (V) | Photosensitivity (lux · sec) | Photosensitivity after 1000 Cycles (lux · sec) |
|---|---|---|---|
| polyester | 850 | 1.8 | 1.8 |
| vinyl chloride/ vinyl acetate copolymer | 570 | 2.0 | 2.4 |
| vinyl chloride/ vinyl acetate/ vinyl alcohol terpolymer | 630 | 2.4 | 2.2 |
| vinyl chloride/ vinyl acetate/ maleic acid terpolymer | 770 | 1.8 | 2.4 |
| polycarbonate | 620 | 2.0 | 1.9 |

Thus, good results are obtained irrespective of the type of binder resin.

EXAMPLE 17

Charge generating compounds of the following formulae were provided.

1.
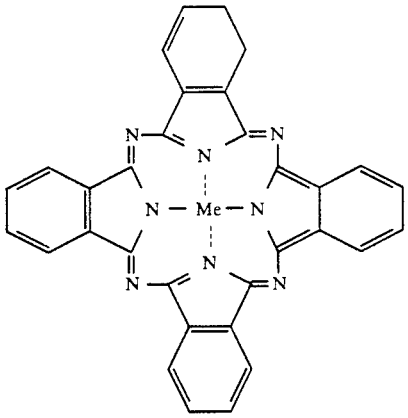
2.
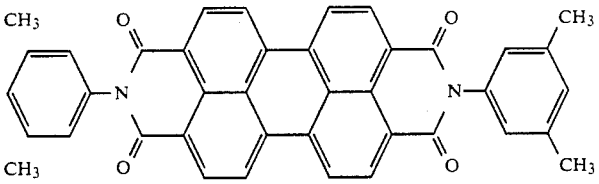
3.
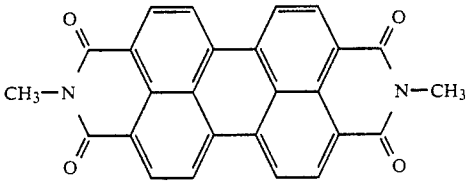
4.
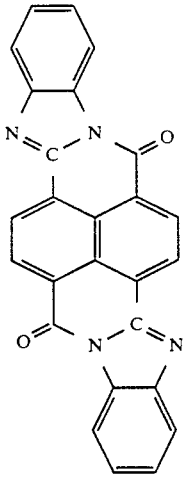
5.
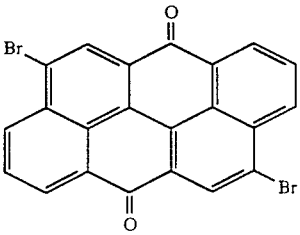

-continued

6.

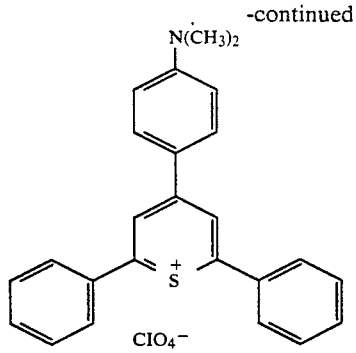

7.

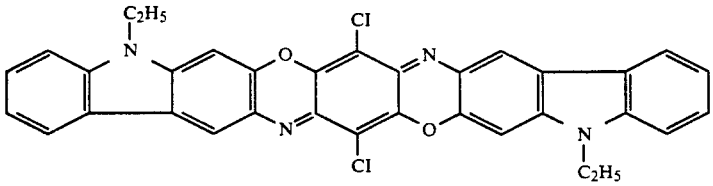

8.

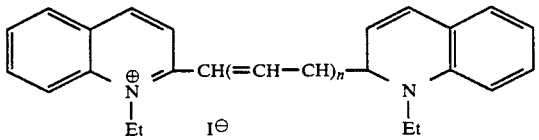

9.

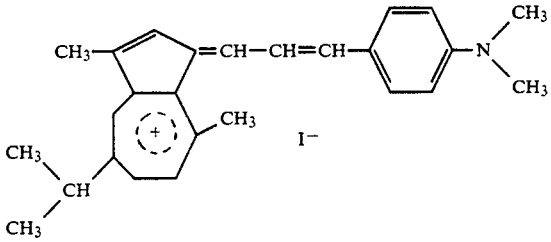

10.

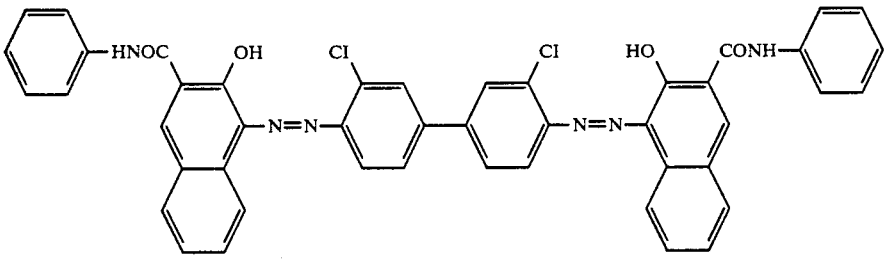

X-Pc (Fastogen Blue 8120B), each charge generating compound as indicated above and polyvinyl butyral (Eslex BM-2) were mixed at mixing ratios by weight of 0.2:0.4:1.8 and dissolved in tetrahydrofuran, followed by sufficiently kneading under agitation for three days. The respective solutions were applied onto an aluminium drum by dipping and treated in vacuum at 120° C. for 1 hour to form a photoconductive layer with a thickness of 10 to 20 μm.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 1000 exposure cycles. The results are shown in Table 15.

TABLE 15

| Charge Generating Compound | Charged Potential (V) | Photosensitivity (lux · sec) | Photosensitivity after 1000 Cycles (lux · sec) |
|---|---|---|---|
| 1 | 700 | 1.4 | 1.4 |
| 2 | 850 | 2.0 | 2.1 |
| 3 | 900 | 3.1 | 3.1 |
| 4 | 710 | 2.2 | 2.2 |
| 5 | 620 | 2.4 | 2.0 |
| 6 | 500 | 2.0 | 2.5 |
| 7 | 750 | 1.8 | 2.0 |
| 8 | 550 | 1.5 | 1.8 |
| 9 | 680 | 2.0 | 2.6 |
| 10 | 710 | 2.6 | 3.5 |

Thus, the various charge generating compounds are used in combination with X-Pc. Since these compounds have a good charge generating ability relative to light with an inherent wavelength, characteristic photosensitive materials can be obtained using the respective combinations of the charge generating compounds.

EXAMPLE 18

The photosensitive material obtained in Example 14 and using X-Pc, the charge generating compound and PVB at mixing ratios of 0.2:0.4:1.8 was used for a continuous printing test. The test was conducted using A4-size paper sheets, from which it was found that the material was stable when 30,000 sheets were continuously printed.

EXAMPLE 19

X-Pc (Fastogen Blue 8120B) and PVB (Eslex BM-2) were weighed at different ratios indicated in Table 16 and dissolved in tetrahydrofuran, followed by kneading under agitation for three days to obtain a solution. Each solution was applied onto an aluminum drum by dipping and treated in vacuum at 120° C. for 1 hour to obtain a 10 to 20 μm thick photoconductive layer. Each drum was held with three rolls and rotated to make a smooth surface of the photoconductive layer formed on the drum.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 16.

TABLE 16

| | | | Photosensitivity | | |
|---|---|---|---|---|---|
| X-Pc | PVB | Charged Potential (V) | Initial Half-life Exposure (lux · sec) | Half-life Exposure After 1000 Cycles (lux · sec) | Wavelength Characteristic ($cm^2/\mu J$) |
| 1 | 0.8 | 200 | 0.6 | 0.8 | 2.9 |
| 1 | 1 | 300 | 0.6 | 0.7 | 2.8 |
| 1 | 1.5 | 350 | 0.7 | 0.7 | 2.6 |
| 1 | 2 | 410 | 0.8 | 0.8 | 2.5 |
| 1 | 3 | 530 | 1.0 | 0.9 | 2.4 |
| 1 | 4 | 600 | 1.0 | 1.0 | 2.2 |
| 1 | 5 | 700 | 1.5 | 1.4 | 1.8 |
| 1 | 8 | 910 | 1.8 | 2.0 | 1.8 |
| 1 | 10 | 1200 | 2.5 | 2.5 | 1.2 |
| 1 | 20 | 2000 | 3.8 | 5.2 | 0.6 |
| 1 | 50 | >2000 | >10 | >10 | >0.1 |

When this type of photosensitive material was subjected to printing, the filming phenomenon was reduced to not larger than 1/10 of the photosensitive material whose surface was not smoothed.

EXAMPLE 20

τ-Pc (Liophoton THP) and PVB at different mixing ratios by weight were dissolved in a mixed solvent of tetrahydrofuran and methylnaphthalene (mixing ratio by weight of 10:1) and kneaded sufficiently under agitation for three days. The resultant solutions were each applied onto an aluminium drum by dipping and treated in vacuum at 100° C. for 1 hour to remove mainly the tetrahydrofuran, thereby forming a photoconductive layer with a thickness of 10 to 20 μm. The drum was held with three rolls to smooth the layer surface on the drum. Thereafter, the layer was dried at 150° C. for 2 hours to remove the methylnaphthalene, thereby obtaining a photosensitive drum.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 17.

TABLE 17

| | | | Photosensitivity | | |
|---|---|---|---|---|---|
| τ-Pc | PVB | Charged Potential (V) | Initial Half-life Exposure (lux · sec) | Half-life Exposure After 1000 Cycles (lux · sec) | Wavelength Characteristic ($cm^2/\mu J$) |
| 1 | 0.8 | 180 | 0.7 | 0.8 | 2.9 |
| 1 | 1 | 300 | 0.8 | 0.7 | 2.5 |
| 1 | 1.5 | 320 | 1.0 | 0.9 | 2.5 |
| 1 | 2 | 460 | 1.1 | 1.0 | 2.3 |
| 1 | 3 | 570 | 1.2 | 1.2 | 2.2 |
| 1 | 4 | 620 | 1.2 | 1.3 | 2.0 |
| 1 | 5 | 820 | 1.6 | 1.6 | 1.8 |
| 1 | 8 | 920 | 1.8 | 1.8 | 1.5 |
| 1 | 10 | 1400 | 2.6 | 2.7 | 1.1 |
| 1 | 20 | 2000 | 4.7 | 5.6 | 0.4 |
| 1 | 50 | >2000 | >10 | >10 | >0.1 |

These photosensitive drums exhibited good printing characteristics and the filming phenomenon was reduced to not larger than 1/20 of the case where the surface was not smoothed. τ-Pc exhibited excellent photosensitive characteristics as X-Pc.

EXAMPLE 21

X-Pc and various binder resins were weighted at different mixing ratios by weight and were each dissolved in a mixed solvent of tetrahydrofuran and N-methylpyrrolidone (mixing ratio by weight of 10:1) and kneaded sufficiently under agitation for three days. The resultant solution was applied onto an aluminium drum by dipping and treated in vacuum at 100° C. for 1 hour to remove mainly the tetrahydrofuran, thereby forming a photoconductive layer with a thickness of 10 to 20 μm. The drum was held with three rolls to smooth the layer surface on the drum. Thereafter, the layer was dried at 150° C. for 2 hours to remove the methylnaphthalene, thereby obtaining a photosensitive drum.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 18.

TABLE 18

| Polymer | Charged Potential (V) | Photosensitivity (lux · sec) | Photosensitivity after 1000 Cycles (lux · sec) | Wavelength Characteristic ($cm^2/\mu J$) |
|---|---|---|---|---|
| polyester | 780 | 1.1 | 1.8 | 0.9 |
| vinyl chloride/ | 600 | 1.6 | 1.5 | 1.8 |

TABLE 18-continued

| Polymer | Charged Potential (V) | Photosensitivity (lux · sec) | Photosensitivity after 1000 Cycles (lux · sec) | Wavelength Characteristic ($cm^2/\mu J$) |
|---|---|---|---|---|
| vinyl acetate copolymer | | | | |
| vinyl chloride/vinyl acetate/vinyl alcohol terpolymer | 630 | 1.4 | 1.5 | 1.8 |
| vinyl chloride/vinyl acetate/maleic acid terpolymer | 770 | 1.2 | 1.4 | 2.0 |
| polycarbonate | 620 | 1.4 | 1.4 | 2.0 |

Thus, good results are obtained irrespective of the type of binder resin. The filming phenomenon was reduced to not larger than 1/20 of that of a photosensitive material whose surface was not smoothed.

EXAMPLE 22

The photosensitive material obtained in Example 19 and using X-Pc and PVB at a mixing ratio of 1:4 was used for a continuous printing test. The test was conducted using A4-size paper sheets, from which it was found that the material was stable when 30,000 sheets were continuously printed.

EXAMPLE 23

X-Pc and PVB (Eslex BM2) dissolved in isopropyl alcohol were weighed at a ratio by weight of 1:1 as solid and kneaded under agitation for three days. The resultant solution was applied onto an aluminium drum by dipping and treated in vacuum at 120° C. for 1 hour to form a charge generating layer with a thickness of from 2 to 5 μm. X-Pc is not dissolved in the alcohol and is considered to be dispersed in the layer in a particulate state.

X-Pc and a polyester (Vylon 200, available from Toyobo Ltd.) were weighted at different mixing ratios by weight and dissolved in tetrahydrofuran at a solid content of 20 wt %. The resultant solutions were each applied onto the charge generating layer in a thickness of from 10 to 20 μm.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 19.

TABLE 19

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 200 | 0.7 | 0.8 | 2.7 |
| 1 | 1 | 220 | 0.7 | 0.7 | 2.6 |
| 1 | 1.5 | 310 | 0.8 | 0.9 | 2.4 |
| 1 | 2 | 410 | 0.8 | 0.8 | 2.4 |
| 1 | 3 | 530 | 1.0 | 1.1 | 2.4 |
| 1 | 4 | 600 | 1.6 | 1.6 | 1.8 |

TABLE 19-continued

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 5 | 700 | 1.6 | 1.6 | 1.8 |
| 1 | 8 | 910 | 1.8 | 2.0 | 1.8 |
| 1 | 10 | 1200 | 2.5 | 2.5 | 1.8 |
| 1 | 20 | 2000 | 3.5 | 3.2 | 1.6 |
| 1 | 50 | >2000 | >10 | >10 | >0.1 |

From the above results, it will be seen that the charge generating layer provided between the X-Pc layer and the substrate is effective.

EXAMPLE 24

The general procedure of Example 23 was repeated using τ-Pc (Liophoton THP) was used instead of X-Pc in each layer to form a double layer structure. Good photosensitive characteristics as with the case of X-Pc were obtained.

EXAMPLE 25

X-Pc and various binder resins were mixed at a mixing ratio by weight of 1:5 and dissolved in tetrahydrofuran, followed by kneading under agitation to obtain solutions. Each solution was applied onto a charge generating layer formed in the same manner as in Example 23 and treated in vacuum at 120° C. for 1 hour to form a photoconductive layer with a thickness of 10 to 20 μm.

The resultant photosensitive materials were each evaluated in the same manner as in Example 23. The results are shown in Table 20 below.

TABLE 20

| Polymer | Charged Potential (V) | Photosensitivity (lux · sec) | Photosensitivity after 1000 Cycles (lux · sec) | Wavelength Characteristic ($cm^2/\mu J$) |
|---|---|---|---|---|
| polyester | 780 | 1.6 | 1.6 | 1.8 |
| vinyl chloride/vinyl acetate copolymer | 600 | 1.6 | 1.5 | 2.0 |
| vinyl chloride/vinyl acetate/vinyl alcohol terpolymer | 630 | 1.5 | 1.5 | 2.1 |
| vinyl chloride/vinyl acetate/maleic acid terpolymer | 770 | 1.3 | 1.4 | 2.1 |
| polycarbonate | 620 | 1.6 | 1.5 | 2.1 |

The photosensitive materials with a double-layered structure are excellent in the photosensitive characteristics irrespective of the type of binder resin.

EXAMPLE 26

The photosensitive material obtained in Example 23 and using a photoconductive layer having a ratio by weight of X-Pc and the polyester of 1:5 was subjected to a continuous printing test using A4-size paper sheets. The material was stably worked when 30,000 sheets were continuously printed.

EXAMPLE 27

X-Pc (Fastogen Blue 8120B) and a polyester (Vylon 220) were weighed at different ratios by weight and dissolved in tetrahydrofuran, followed by kneading under agitation for two days. The resultant solutions were each applied onto an aluminium drum by dipping and treated in vacuum at 120° C. for 1 hour to form a photoconductive layer with a thickness of 10 to 20 μm.

The resultant photosensitive materials were subjected to measurement of an X-ray diffraction pattern by the use of an X-ray diffractometer (RAD-B System, available from Rigaku Electric Co., Ltd.) using a CuK α ray as a light source.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured.

In the X-ray diffraction pattern of the photosensitive material using X-Pc and the polyester at a mixing ratio by weight of 1:4. The diffraction line intensity ratio, $I_{11.8}/I_{9.8}$, was 0.8. This is completely different from the intensity ratio of 1.5 for the starting X-Pc. The ratio was substantially constant when the ratio by weight of X-Pc and the polyester was varied. The photosensitive characteristics for different ratios by weight of X-Pc and the polyester are shown in Table 21 below.

TABLE 21

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 250 | 0.7 | 0.8 | 2.7 |
| 1 | 1 | 400 | 0.7 | 0.7 | 2.7 |
| 1 | 1.5 | 450 | 0.8 | 0.7 | 2.4 |
| 1 | 2 | 520 | 1.0 | 1.0 | 2.1 |
| 1 | 3 | 650 | 1.3 | 1.2 | 1.9 |
| 1 | 4 | 720 | 1.3 | 1.3 | 1.9 |
| 1 | 5 | 830 | 1.5 | 1.4 | 1.7 |
| 1 | 8 | 960 | 1.9 | 2.0 | 1.5 |
| 1 | 10 | 1260 | 2.5 | 2.4 | 1.1 |
| 1 | 20 | 2000 | 4.5 | 5.0 | 0.6 |
| 1 | 50 | >2000 | >10 | >10 | >0.1 |

The results reveal that the ratio by weight of X-Pc and the polyester is preferably in the range of from 1:1 to 1:10 as in the case using PVB.

EXAMPLE 28

X-Pc and PVB were weighed at a mixing ratio by weight of 1:4 and dissolved in tetrahydrofuran for different times ranging from 0.5 to 72 hours. The resultant solutions were each applied onto an aluminium drum by dipping and treated in vacuum at 120° C. for 1 hour to form a photoconductive layer with a thickness of from 10 to 20 μm.

The thus obtained photosensitive materials were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. Also, the X-ray diffraction pattern was measured for the respective materials to determine the intensity ratio, $I_{11.8}/I_{9.8}$. The relation between the intensity ratio and the photosensitive characteristics are shown in Table 22 below.

TABLE 22

| Diffraction Intensity Ratio ($I_{11.8}/I_{9.8}$) | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|
| 1.2 | 680 | 3.7 | 3.9 | 0.8 |
| 1 | 700 | 2.5 | 2.5 | 1.2 |
| 0.8 | 620 | 1.2 | 1.3 | 2.0 |
| 0.6 | 560 | 1.1 | 1.0 | 2.3 |
| 0.4 | 580 | 1.2 | 1.2 | 2.2 |
| 0.2 | 620 | 1.2 | 1.5 | 2.0 |
| 0.1 | 550 | 1.0 | 2.9 | 2.4 |
| 0.05 | 420 | 1.0 | 4.9 | 2.5 |

The intensity ratios of 1.2, 1, 0.8, 0.6, 0.4, 0.2, 0.1 and 0.05, respectively, corresponded to the times of 0.5, 2. 4. 8. 12. 24. 48 and 72 hours.

As will be apparent from the above results, when the intensity ratio is in the range of from 0.8 to 0.1, good characteristics are obtained. This range is preferred. When, the intensity ratio is less than 0.1, good photosensitive characteristics are obtained but the stability by repetition becomes slight lower.

COMPARATIVE EXAMPLE 4

The general procedure of Example 28 was repeated except that n-butyl alcohol was used as the solvent and the kneading time was 48 hours. X-Pc was not dissolved in n-butyl alcohol but PVB was dissolved therein. The results are shown in Table 23 below.

TABLE 23

| X-Pc | PVB | Charged Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 210 | 6.7 | 6.8 | 0.1 |
| 1 | 1 | 330 | 7.2 | 7.8 | 0.08 |
| 1 | 2 | 450 | 9.8 | 9.8 | 0.07 |
| 1 | 5 | 650 | 11.8 | 12.0 | 0.04 |
| 1 | 10 | 980 | 25.5 | 21.5 | 0.02 |
| 1 | 20 | >2000 | >30.0 | >30.0 | >0.01 |

The photosensitivity is very poor as compared with the results of Tables 21 and 22. Thus, it is necessary that part of X-Pc be dispersed in the layer in a molecular state.

EXAMPLE 29

X-Pc and various binder resins were mixed at a mixing ratio by weight of 1:4 and dissolved in tetrahydrofuran, followed by kneading under agitation to obtain solutions. Each solution was applied onto an aluminium drum by dipping and treated in vacuum at 120° C. for 1 hour to form a photoconductive layer with a thickness of 10 to 20 μm. The kneading time was so controlled that the intensity ratio of the X-ray diffraction peaks was in the range of from 0.8 to 0.5. For this purpose, the kneading time was in the range of from 24 to 72 hours.

The resultant photosensitive materials were each evaluated in the same manner as in Example 26. The results are shown in Table 24 below.

TABLE 24

| Polymer | Charged Potential (V) | Photosensitivity (lux · sec) | Photosensitivity after 1000 Cycles (lux · sec) | Wave-length Characteristic ($cm^2/\mu J$) |
|---|---|---|---|---|
| vinyl chloride/vinyl acetate copolymer | 600 | 1.6 | 1.5 | 1.8 |
| vinyl chloride/vinyl acetate/vinyl alcohol terpolymer | 630 | 1.4 | 1.5 | 1.8 |
| vinyl chloride/vinyl acetate/maleic acid terpolymer | 870 | 1.4 | 1.4 | 2.0 |
| polycarbonate | 660 | 1.4 | 1.3 | 2.0 |
| polystyrene | 800 | 1.5 | 1.5 | 1.9 |
| polymethyl methacrylate | 950 | 1.4 | 1.5 | 2.0 |

The photosensitive materials are excellent in the photosensitive characteristics irrespective of the type of binder resin.

EXAMPLE 30

The photosensitive material obtained in Example 27 and using a photoconductive layer having a ratio by weight of X-Pc and the polyester of 1:4 was subjected to a continuous printing test using A4-size paper sheets. The material was stably worked when 30,000 sheets were continuously printed.

What is claimed is:

1. A photosensitive material for electrophotography which is adapted for positive charging and which comprises a conductive support and an organic photoconductive layer formed on the conductive support and formed from a mixture of the least one compound selected from the group consisting of X-type metal-free phthalocyanine and $\tau$-type metal-free phthalocyanine and a binder resin which has been mixed in a solvent system for both the at least one compound and the binder resin such that said at least one compound is dispersed in said binder resin partly in a molecular state and partly in a particulate state and until said photoconductive layer exhibits both charge transportability and charge generating ability.

2. A photosensitive material according to claim 1, wherein said at least one compound is used at a mixing ratio by weight, to the binder resin, of 2:1 to 1:10.

3. A photosensitive material according to claim 1, wherein said at least one compound is X-type metal-free phthalocyanine.

4. A photosensitive material according to claim 1, wherein said at least one compound is $\tau$-type metal-free phthalocyanine.

5. A photosensitive material according to claim 1, wherein said at least one compound is a mixture of X-type metal-free phthalocyanine and $\tau$-type metal-free phthalocyanine.

6. A photosensitive material according to claim 1, wherein said at least one compound is X-type metal-free phthalocyanine compound which present in the photoconductive layer in such a way that a ratio of an X-ray diffraction intensity from a crystal plane with a lattice spacing of about 11.8 angstroms and an X-ray diffraction intensity from a crystal plane with a lattice spacing of about 9.8 angstroms is in the range of 1:1 to 1:0.1.

7. A photosensitive material according to claim 1, wherein said at least one charge generating compound is a $\tau$-type phthalocyanine compound which is present in the photoconductive layer in such a way that a ratio of an X-ray diffraction intensity from a crystal plane with a lattice spacing of about 11.8 angstroms and an X-ray diffraction intensity from a crystal plane with a lattice spacing of about 9.8 angstroms is in the range of 1:1 to 1:0.1.

8. A photosensitive material according to claim 1, wherein said binder resin is a resin capable of being dissolved in a solvent which is able to at least partially dissolve the at least one phthalocyanine compound.

9. A photosensitive material according to claim 8, wherein said binder resin is a member selected from the group consisting of polyesters, polyvinyl acetate, polyvinyl chloride, polyvinylidene chloride, polycarbonates, polyvinyl butyral, polyvinyl acetoacetals, polyvinyl formal, polyacrylonitrile, polymethyl methacrylate, polyacrylates, copolymers of monomers for the above-defined polymers, poly(vinyl chloride/vinyl acetate/vinyl alcohol), poly(vinyl chloride/vinyl acetate/maleic acid, poly(ethylene/vinyl acetate), poly(vinyl chloride/vinylidene chloride), cellulose derivatives and mixtures thereof.

10. A photosensitive material according to claim 8, wherein said binder resin is methylphenylsiloxane or dimethylsiloxane.

11. A photosensitive material according to claim 8, wherein said binder resin is a methylphenylsiloxane or dimethylsiloxane-modified polymer.

12. A photosensitive material according to claim 11, wherein the polymer modified with the siloxane is an alkyd resin, an acrylic resin, a carbonate resin, a polyester resin or a polyimide resin.

13. A photosensitive material according to claim 8, wherein said binder resin is a mixture of methylphenylsiloxane or dimethylsiloxane and an organic polymer.

14. A photosensitive material according to claim 13, wherein said organic polymer is an alkyd resin, an acrylic resin, a carbonate resin, a polyester resin or a polyimide resin.

15. A photosensitive material according to claim 1, wherein said binder resin is a cured product of a heat or light-curable resin.

16. A photosensitive material according to claim 15, wherein said heat or light-curable resin is a polymer or copolymer of acrylates and/or methacrylates having a vinyl group or an epoxy group at side chains.

17. A photosensitive material according to claim 15, wherein said heat or light-curable resin is a polystyrene having a chalcone structure at side chains thereof.

18. A photosensitive material according to claim 1, wherein said photoconductive layer is a smoothed surface.

19. A photosensitive material according to claim 18, wherein said smoothed surface is formed by rolling the photoconductive layer.

20. A photosensitive material according to claim 19, wherein said smoothed surface is formed by mixing the at least one compound and the binder resin in a mixture of two solvents therefor having different boiling points, applying the mixture on the conductive support, heating the applied mixture to form the photoconductive layer on the support under so that a lower boiling solvent is mainly removed by the heating while leaving most of a higher boiling solvent, rolling the photoconductive layer, and drying the rolled layer to remove the higher boiling solvent.

21. A photosensitive material according to claim 1, wherein said photoconductive layer further comprises a charge generating compound other than the phthalocyanine used, which is dispersed in the binder resin.

22. A photosensitive material according to claim 1, further comprising a layer of a charge generating compound provided between said photoconductive layer and said conductive support, said charge generating compound being dispersed in a resin binder in a particulate form.

23. A photosensitive material according to claim 22, wherein said charge generating compound is a phthalocyanine.

24. A photosensitive material according to claim 22, wherein said charge generating compound is a compound selected from the group consisting of metal-free phthalocyanine compounds, metalo-phthalocyanine compounds, perylene compounds, thiapyrilium compounds, anthanthrone compounds, squalilium compounds, cyanine compounds, bisazo compounds, trisazo compounds and azulenium compounds.

* * * * *